US011014634B2

(12) United States Patent
Hartman

(10) Patent No.: US 11,014,634 B2
(45) Date of Patent: May 25, 2021

(54) HYDRAULIC POWER SOURCES FOR WATERCRAFT AND METHODS FOR PROVIDING HYDRAULIC POWER ABOARD A WATERCRAFT

(71) Applicant: Richard L. Hartman, Twin Lakes, ID (US)

(72) Inventor: Richard L. Hartman, Twin Lakes, ID (US)

( * ) Notice: Subject to any disclaimer, the term of this patent is extended or adjusted under 35 U.S.C. 154(b) by 0 days.

(21) Appl. No.: 17/097,543

(22) Filed: Nov. 13, 2020

(65) Prior Publication Data

US 2021/0061422 A1 Mar. 4, 2021

Related U.S. Application Data

(63) Continuation-in-part of application No. 16/841,484, filed on Apr. 6, 2020, now Pat. No. 10,864,971, (Continued)

(51) Int. Cl.

| | |
|---|---|
| ***B63B 32/70*** | (2020.01) |
| ***B63B 32/40*** | (2020.01) |
| ***B63B 32/20*** | (2020.01) |
| ***B63B 13/00*** | (2006.01) |
| ***B63B 39/03*** | (2006.01) |
| ***B63B 43/06*** | (2006.01) |

(52) U.S. Cl.

CPC ..... *B63B 32/70* (2020.02); *B63B 32/20* (2020.02); *B63B 13/00* (2013.01); *B63B 32/40* (2020.02); *B63B 39/03* (2013.01); *B63B 43/06* (2013.01)

(58) Field of Classification Search

CPC ..... B63H 3/00; B63H 25/00; B63H 25/46; B63B 32/00; B63B 32/20; B63B 32/70; B63B 32/40; B63B 13/00; B63B 39/00; B63B 39/03; B63B 43/00; B63B 43/06; F16H 15/28; F16H 37/02

USPC ..... 114/121, 125, 151; 440/49, 50

See application file for complete search history.

(56) References Cited

U.S. PATENT DOCUMENTS

| | | | |
|---|---|---|---|
| 4,095,547 | A | 6/1978 | Benington |
| 4,135,394 | A | 1/1979 | Middleton |

(Continued)

OTHER PUBLICATIONS

Allegro MicroSystems, Inc., "Fully Integrated, Half Effect-Based Linear Current Sensor IC with 2.1. kVRMS Isolation and a Low-Resistance Current Conductor", ACS713-DS, Rev. 11, Oct. 12, 2011, United States, 14 pages.

(Continued)

*Primary Examiner* — Lars A Olson

(74) *Attorney, Agent, or Firm* — Wells St. John P.S.

(57) ABSTRACT

The present disclosure provides hydraulic power sources for watercraft. Example power sources can include: a watercraft having an engine; a variable ratio drive assembly operably engaged with the engine; a hydraulic pump operably engaged with the variable ratio drive assembly; and a hydraulic motor powered by the hydraulic pump. The present disclosure also provides methods for providing hydraulic power aboard a watercraft. Example methods can include: using an engine of the watercraft to drive a variable ratio drive assembly; using the variable ratio drive assembly to drive a hydraulic pump; using the hydraulic pump to power a hydraulic motor; and using the hydraulic motor to drive a load.

17 Claims, 18 Drawing Sheets

Related U.S. Application Data which is a continuation-in-part of application No. 16/673,846, filed on Nov. 4, 2019, now Pat. No. 10,611,440, which is a continuation-in-part of application No. 16/577,930, filed on Sep. 20, 2019, now Pat. No. 10,745,089, which is a continuation-in-part of application No. 16/576,536, filed on Sep. 19, 2019, now Pat. No. 10,611,439, which is a continuation-in-part of application No. 16/279,825, filed on Feb. 19, 2019, now Pat. No. 10,435,122, which is a continuation of application No. 16/255,578, filed on Jan. 23, 2019, now Pat. No. 10,442,509, which is a continuation-in-part of application No. 16/255,578, filed on Jan. 23, 2019, now Pat. No. 10,442,509, which is a continuation of application No. 15/699,127, filed on Sep. 8, 2017, now Pat. No. 10,227,113, which is a continuation-in-part of application No. 15/699,127, filed on Sep. 8, 2017, now Pat. No. 10,227,113.

(60) Provisional application No. 62/385,842, filed on Sep. 9, 2016.

(56) References Cited

U.S. PATENT DOCUMENTS

| | | | | |
|---|---|---|---|---|
| 4,220,044 | A | 9/1980 | LeBlanc et al. | |
| 4,611,549 | A | 9/1986 | Kodera et al. | |
| 4,741,676 | A | 5/1988 | Janes | |
| 4,749,926 | A | 6/1988 | Ontolchik | |
| 4,864,287 | A | 9/1989 | Kierstead | |
| 4,872,118 | A | 10/1989 | Naidenov et al. | |
| 5,006,086 | A | 4/1991 | Latham | |
| 5,203,727 | A | 4/1993 | Fukui | |
| 5,215,025 | A | 6/1993 | Talmor | |
| 5,324,170 | A | 6/1994 | Anastos et al. | |
| 5,385,110 | A | 1/1995 | Bennett et al. | |
| 5,473,497 | A | 12/1995 | Beatty | |
| 5,549,071 | A | 8/1996 | Pigeon et al. | |
| 5,787,835 | A | 8/1998 | Remnant | |
| 5,860,384 | A | 1/1999 | Castillo | |
| 6,009,822 | A | 1/2000 | Aron | |
| 6,012,408 | A | 1/2000 | Castillo | |
| 6,044,788 | A | 4/2000 | Larson et al. | |
| 6,105,527 | A | 8/2000 | Lochtefeld et al. | |
| 6,158,375 | A | 12/2000 | Stuart, Jr. | |
| 6,162,141 | A | 12/2000 | Rointru et al. | |
| 6,234,099 | B1 | 5/2001 | Jessen | |
| 6,374,762 | B1 | 4/2002 | Larson et al. | |
| 6,427,616 | B1 | 8/2002 | Hagen | |
| 6,505,572 | B1 | 1/2003 | Seipel et al. | |
| 6,709,240 | B1 | 3/2004 | Schmalz et al. | |
| 6,904,982 | B2 | 6/2005 | Judge et al. | |
| 6,953,002 | B2 | 10/2005 | Jessen | |
| 7,311,570 | B2 | 12/2007 | Csoke | |
| 7,370,594 | B2 | 5/2008 | Bruckner et al. | |
| 7,568,443 | B2 | 8/2009 | Walker | |
| 7,699,016 | B2 | 4/2010 | Snook et al. | |
| 8,313,404 | B2 | 11/2012 | Carter et al. | |
| 8,393,924 | B1 * | 3/2013 | Daunais | B63H 3/06 440/50 |
| 8,433,463 | B1 | 4/2013 | Lieberman | |
| 8,739,723 | B1 | 6/2014 | Murphy | |
| 8,761,975 | B2 | 6/2014 | Watson | |
| 8,761,976 | B2 | 6/2014 | Salmon | |
| 8,798,825 | B1 | 8/2014 | Hartman | |
| 8,857,356 | B1 | 10/2014 | Murphy | |
| 8,943,988 | B1 | 2/2015 | Guglielmo et al. | |
| 9,068,855 | B1 | 6/2015 | Guglielmo | |
| 9,156,372 | B1 | 10/2015 | Guglielmo et al. | |
| 9,499,242 | B2 | 11/2016 | Hartman | |
| 9,689,395 | B2 | 6/2017 | Hartman | |
| 9,701,366 | B2 | 7/2017 | Larson et al. | |
| 9,828,075 | B1 | 11/2017 | Hartman | |
| 9,915,192 | B2 | 3/2018 | Buschur | |
| 10,030,748 | B2 * | 7/2018 | Haka | F16H 15/28 |
| 10,093,398 | B1 | 10/2018 | Hartman | |
| 10,227,113 | B2 | 3/2019 | Hartman | |
| 10,329,004 | B2 | 6/2019 | Hartman | |
| 10,435,122 | B2 | 10/2019 | Hartman | |
| 10,442,509 | B2 | 10/2019 | Hartman | |
| 10,611,439 | B2 | 4/2020 | Hartman | |
| 10,611,440 | B2 | 4/2020 | Hartman | |
| 10,640,182 | B1 | 5/2020 | Hartman | |
| 10,717,502 | B1 | 7/2020 | Hartman | |
| 10,745,089 | B2 | 8/2020 | Hartman | |
| 10,759,507 | B2 | 9/2020 | Hartman | |
| 10,829,186 | B2 | 11/2020 | Hartman | |
| 10,864,971 | B2 | 12/2020 | Hartman | |
| 10,927,936 | B2 | 2/2021 | Buschur | |
| 2002/0190687 | A1 | 12/2002 | Bell et al. | |
| 2003/0183149 | A1 | 10/2003 | Jessen | |
| 2005/0155540 | A1 | 7/2005 | Moore | |
| 2005/0226731 | A1 | 10/2005 | Mehlhorn et al. | |
| 2006/0009096 | A1 | 1/2006 | Takada et al. | |
| 2008/0026652 | A1 | 1/2008 | Okanishi et al. | |
| 2009/0144039 | A1 | 6/2009 | Thorsteinsson | |
| 2012/0015566 | A1 | 1/2012 | Salmon et al. | |
| 2012/0221188 | A1 | 8/2012 | Kelly, III | |
| 2013/0103236 | A1 | 4/2013 | Mehrgan | |
| 2013/0213293 | A1 | 8/2013 | Gasper et al. | |
| 2013/0228114 | A1 | 9/2013 | Gasper | |
| 2013/0293881 | A1 | 11/2013 | Tokhtuev et al. | |
| 2014/0261135 | A1 | 9/2014 | Gasper et al. | |
| 2015/0126315 | A1 | 5/2015 | Farewell et al. | |
| 2015/0158554 | A1 | 6/2015 | Sheedy et al. | |
| 2016/0310711 | A1 | 10/2016 | Luxon et al. | |
| 2016/0370187 | A1 | 12/2016 | Gatland et al. | |

OTHER PUBLICATIONS

Analog Devices, Inc., "High Accuracy, Dual-Axis Digital Inclinometer and Accelerometer", ADIS16209, Rev. B, 2009, United States, 16 pages.

Analog Devices, Inc., "Programmable 360° Inclinometer", ADIS16203, Rev. A, 2010, United States, 28 pages.

Johnson Pumps et al., "Ultra Ballast—Self-Priming, Flexible Impeller Pump Flange Mounted to DC Motorn 12/24 V", Johnson Ultra Ballast Pump Instruction Manual, 2009, United States, 5 pages.

Medallion Instrumentation Systems, "TigeTouch", Instruction Guide, 15 pages.

Microchip Technology, Inc., "28/40/44/64-Pin, Enhanced Flash Microcontrollers with ECAN™ and NanoWatt XLP Technology", PIC18F66K80 Family, 2010-2012, United States, 622 pages.

Rule, "Tournament Series Livewell/Baitwell Pumps,", Instruction Guide, Rev. A, Jun. 2006, Untied States, 2 pages.

Texas Instruments, "Fast General-Purpose Operational Amplifiers,", SLOS063B, Revised Dec. 2002, United States, 16 pages.

* cited by examiner

HYDRAULIC POWER SOURCES FOR WATERCRAFT AND METHODS FOR PROVIDING HYDRAULIC POWER ABOARD A WATERCRAFT

CROSS REFERENCE TO RELATED APPLICATION

This application is a continuation-in-part of and claims priority to U.S. patent application Ser. No. 16/841,484 which was filed Apr. 6, 2020, entitled "Wakeboat Hydraulic Manifold Assemblies and Methods", which is a continuation-in-part of and claims priority to U.S. patent application Ser. No. 16/576,536 which was filed Sep. 19, 2019, entitled "Wakeboat Engine Hydraulic Pump Mounting Apparatus and Methods", now U.S. Pat. No. 10,611,439 issued Apr. 7, 2020, which is a continuation-in-part of and claims priority to U.S. patent application Ser. No. 16/279,825 which was filed Feb. 19, 2019, entitled "Wakeboat Propulsion Apparatuses and Methods", now U.S. Pat. No. 10,435,122 issued Oct. 8, 2019, which is a continuation-in-part of and claims priority to U.S. patent application Ser. No. 15/699,127 which was filed Sep. 8, 2017, entitled "Wakeboat Engine Powered Ballasting Apparatus and Methods", now U.S. Pat. No. 10,227,113 issued Mar. 12, 2019, which claims priority to U.S. provisional patent application Ser. No. 62/385,842 which was filed Sep. 9, 2016, entitled "Wakeboat Engine Powered Ballasting Apparatus and Methods", the entirety of each of which is incorporated by reference herein. U.S. patent application Ser. No. 16/576,536 is also a continuation-in-part of and claims priority to U.S. patent application Ser. No. 16/255,578 which was filed Jan. 23, 2019, entitled "Wakeboat Engine Powered Ballasting Apparatus and Methods", now U.S. Pat. No. 10,442,509 issued Oct. 15, 2019, which is a continuation of and claims priority to U.S. patent application Ser. No. 15/699,127 which was filed Sep. 8, 2017, entitled "Wakeboat Engine Powered Ballasting Apparatus and Methods", now U.S. Pat. No. 10,227,113 issued Mar. 12, 2019, which claims priority to U.S. provisional patent application Ser. No. 62/385,842 which was filed Sep. 9, 2016, entitled "Wakeboat Engine Powered Ballasting Apparatus and Methods", the entirety of each of which is incorporated by reference herein. U.S. patent application Ser. No. 16/841,484 is also a continuation-in-part of and claims priority to U.S. patent application Ser. No. 16/673,846 which was filed Nov. 4, 2019, entitled "Boat Propulsion Assemblies and Methods", now U.S. Pat. No. 10,611,440 issued Apr. 7, 2020, which is a continuation-in-part of and claims priority to U.S. patent application Ser. No. 16/577,930 which was filed Sep. 20, 2019 entitled "Hydraulic Power Sources for Wakeboats and Methods for Hydraulically Powering a Load from Aboard a Wakeboat"; now U.S. Pat. No. 10,745,089 issued Aug. 18, 2020, which is a continuation of and claims priority to U.S. patent application Ser. No. 16/255,578 which was filed Jan. 23, 2019, entitled "Wakeboat Engine Powered Ballasting Apparatus and Methods"; now U.S. Pat. No. 10,442,509 issued Oct. 15, 2019, which is a continuation of and claims priority to U.S. patent application Ser. No. 15/699,127 which was filed Sep. 8, 2017, entitled "Wakeboat Engine Powered Ballasting Apparatus and Methods", now U.S. Pat. No. 10,227,113 issued Mar. 12, 2019; which claims priority to U.S. provisional patent application Ser. No. 62/385,842 which was filed Sep. 9, 2016, entitled "Wakeboat Engine Powered Ballasting Apparatus and Methods", the entirety of each of which is incorporated by reference herein.

TECHNICAL FIELD

The present disclosure relates to the use of hydraulic fluid aboard watercraft.

BACKGROUND

Watercraft require power at different locations throughout the watercraft other than propulsion. Historically this power has often been electrical, but it has been realized that watercraft electrical power can be inconsistent and unreliable. At least some of these watercraft include wakeboats, but all watercraft are in need of reliable and consistent power.

As just one example, watersports involving powered watercraft have enjoyed a long history. Waterskiing's decades-long popularity spawned the creation of specialized watercraft designed specifically for the sport. Such "skiboats" are optimized to produce very small wakes in the water behind the watercraft's hull, thereby providing the smoothest possible water to the trailing water skier.

More recently, watersports have arisen which actually take advantage of, and benefit from, the wake produced by a watercraft. Wakesurfing, wakeboarding, wakeskating, and kneeboarding all use the watercraft's wake to allow the participants to perform various maneuvers or "tricks" including becoming airborne.

As with waterskiing "skiboats", specialized watercraft known as "wakeboats" have been developed for the wakesurfing, wakeboarding, wakeskating, and/or kneeboarding sports. Contrary to skiboats, however, wakeboats seek to enhance (rather than diminish) the wake produced by the hull using a variety of techniques.

To enhance the wake produced by the hull, water can be pumped aboard from the surrounding water to ballast the wakeboat. Unfortunately, existing art in this area is fraught with time limitations, compromises, challenges, and in some cases outright dangers to the safe operation of the wakeboat.

Watercraft can require controlled and reliable power for accessories throughout the boat. Power sources for these requirements and methods for providing same are provided herein.

SUMMARY OF THE DISCLOSURE

The present disclosure provides hydraulic power sources for watercraft. Example power sources can include: a watercraft having an engine; a variable ratio drive assembly operably engaged with the engine; a hydraulic pump operably engaged with the variable ratio drive assembly; and a hydraulic motor powered by the hydraulic pump.

The present disclosure also provides methods for providing hydraulic power aboard a watercraft. Example methods can include: using an engine of the watercraft to drive a variable ratio drive assembly; using the variable ratio drive assembly to drive a hydraulic pump; using the hydraulic pump to power a hydraulic motor; and using the hydraulic motor to drive a load.

The present disclosure provides apparatus and methods that improves the speed, functionality, and safety of wakeboat ballasting operations. A ballasting apparatus for wakeboats is provided, comprising a wakeboat with a hull and an engine; a hydraulic pump, mechanically driven by the engine; a hydraulic motor, powered by the hydraulic pump;

a ballast compartment; and a ballast pump, powered by the hydraulic motor. A ballasting apparatus for wakeboats is provided, comprising a wakeboat with a hull and an engine; a ballast compartment; and a hydraulic ballast pump, the ballast pump configured to be powered by the engine, the ballast outlet and/or inlet of the ballast pump connected to the ballast compartment, the ballast pump configured to pump ballast in and/or out of the ballast compartment. A ballast pump priming system for wakeboats is provided, comprising a wakeboat with a hull and an engine; a ballast pump on the wakeboat; a fitting on the ballast pump which permits water to be introduced into the housing of the ballast pump; and a source of pressurized water, the pressurized water being fluidly connected to the fitting, the pressurized water thus flowing into the housing of the ballast pump.

Hydraulic pump-accessory assemblies are provided for engines. The assemblies can include: an accessory pulley or gear configured to engage a drive belt or chain of an engine; and a hydraulic pump operatively engaging the pulley or gear to be driven by the engine.

Engines are provided that can include: a crankshaft pulley or gear operably engaging a belt or chain to convey power to one or more accessories; an accessory pulley or gear operably engaged by the belt or chain; and a hydraulic pump operatively engaging the accessory pulley or gear to receive power from the belt or chain.

Methods for modifying an engine are also provided. The methods can include operatively engaging a hydraulic motor to the pulley or gear of an accessory configured to be operably engaged with a belt or chain of the engine.

Hydraulic manifold assemblies for wakeboats are provided. The assemblies can include: a chamber configured as a hydraulic fluid source; at least one conduit in selective fluid communication with the chamber; at least one valve operatively aligned with the at least one conduit; and processing circuitry operatively coupled to the at least one valve.

Wakeboats are also provided that can include: an engine; a hydraulic pump powered by the engine; and a hydraulic manifold assembly in fluid communication with the hydraulic pump.

Methods for distributing hydraulic fluid aboard a wakeboat are provided. The methods can include controlling at least one valve to provide hydraulic fluid from a hydraulic pump to one or more hydraulic components.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

The assemblies and methods of the present disclosure will be described with reference to FIGS. 1-18.

Watercraft require onboard power throughout the boat, not just at the propeller. For example, participants in the sports of wakesurfing, wakeboarding, wakeskating, and other wakesports often have different needs and preferences with respect to the size, shape, and orientation of the wake behind a wakeboat. A variety of schemes for creating, enhancing, and controlling a wakeboat's wake have been developed and marketed with varying degrees of success.

The predominant technique for controlling the wake produced by a wakeboat is water itself—brought onboard the wakeboat from the surrounding body of water as a ballast medium to change the position and attitude of the wakeboat's hull in the water. Ballast compartments are installed in various locations within the watercraft, and one or more ballast pumps are used to fill and empty the compartments. The resulting ballast system can control and/or adjust the amount and distribution of weight within the watercraft.

Figure 1:
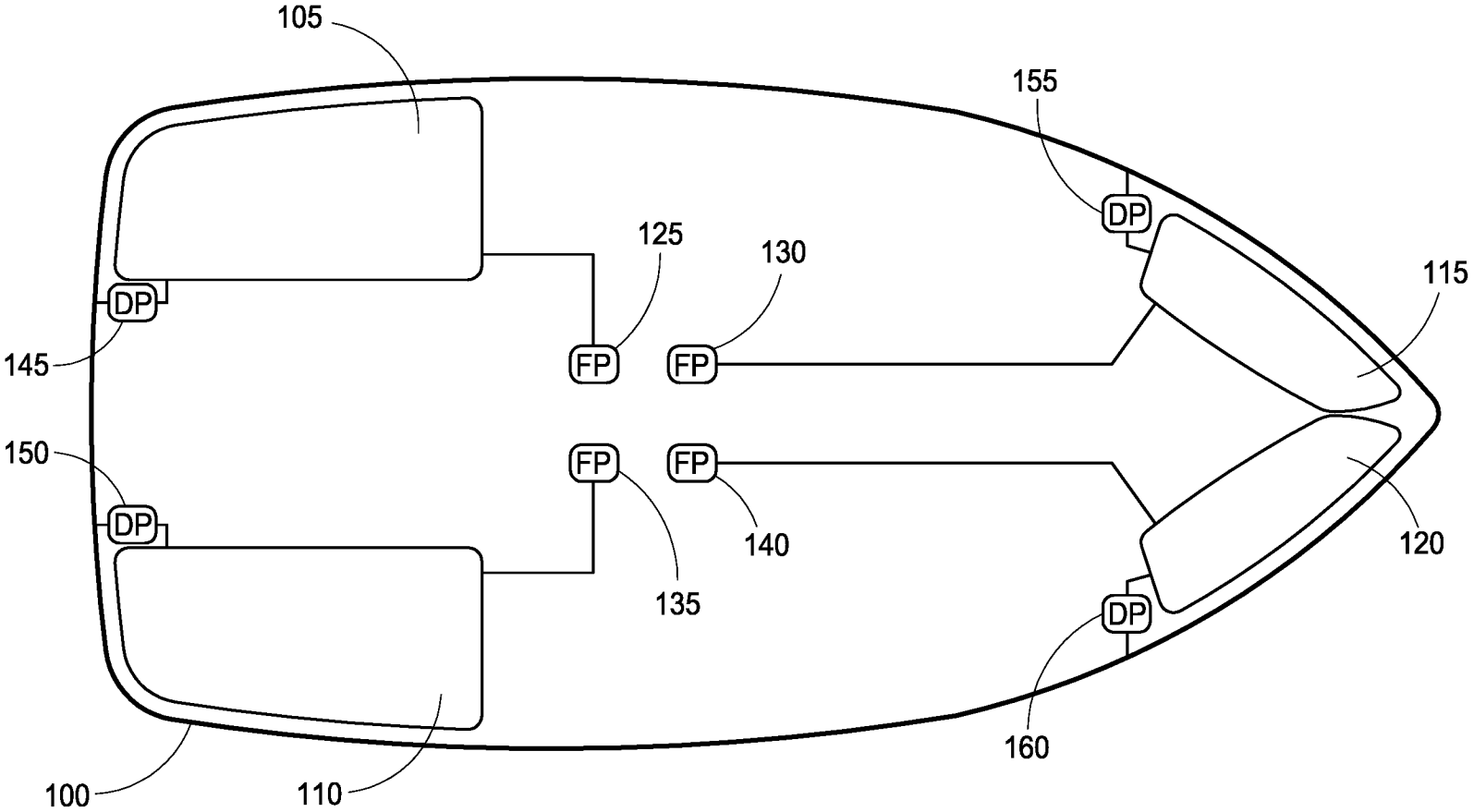
FIG. 1 illustrates a configuration of a wakeboat ballast system according to an embodiment of the disclosure.

FIG. 1 illustrates one configuration of a watercraft ballast system for example purposes only. Within confines of a watercraft hull 100, four ballast compartments are provided: A port aft (left rear) ballast compartment 105, a starboard aft (right rear) ballast compartment 110, a port bow (left front) ballast compartment 115, and a starboard bow (right front) ballast compartment 120.

Two electric ballast pumps per ballast compartment can be provided to, respectively, fill and drain each ballast compartment. For example, ballast compartment 105 is filled by Fill Pump (FP) 125 which draws from the body of water in which the watercraft sits through a hole in the bottom of the watercraft's hull, and is drained by Drain Pump (DP) 145 which returns ballast water back into the body of water. Additional Fill Pumps (FP) and Drain Pumps (DP) operate in like fashion to fill and drain their corresponding ballast compartments. While FIG. 1 depicts separate fill and drain pumps for each ballast compartment, other pump arrangements can include a single, reversible pump for each compartment that both fills and drains that compartment. The advantages and disadvantages of various pump types will be discussed later in this disclosure.

FIG. 1 depicts a four-compartment ballast system, for example. Other arrangements and compartment quantities may be used. Some watercraft manufacturers install a compartment along the centerline (keel) of the hull, for example. Some designs use a single wider or horseshoe shaped compartment at the front (bow) instead of two separate compartments. Many configurations are possible and new arrangements continue to appear.

The proliferation of watercraft ballast systems and centralized vessel control systems has increased their popularity, but simultaneously exposed many weaknesses and unresolved limitations. One of the most serious problems was, and continues to be, the speed at which the electric ballast pumps can fill, move, and drain the water from the ballast compartments.

While more ballast is considered an asset in the wakeboating community (increased ballast yields increased wake size), large amounts of ballast can quickly become a serious, potentially even life threatening, liability if something goes wrong. Modern watercrafts often come from the factory with ballast compartments that can hold surprisingly enormous volumes and weights of water. As just one example, the popular Malibu 25LSV wakeboat (Malibu Boats, Inc., 5075 Kimberly Way, Loudon Tenn. 37774, United States) has a manufacturer's stated ballast capacity of 4825 pounds. The significance of this figure becomes evident when compared against the manufacturer's stated weight of the watercraft itself: Just 5600 pounds.

The ballast thus nearly doubles the vessel's weight. While an advantage for wakesports, that much additional weight becomes a serious liability if, for some reason, the ballast compartments cannot be drained fast enough. One class of popular electric ballast pump is rated by its manufacturer at 800 GPH; even if multiple such pumps are employed, in the event of an emergency it could be quite some time before all 4825 pounds of ballast could be evacuated.

During those precious minutes, the ballast weight limits the speed at which the vessel can move toward safety (if, indeed, the emergency permits it to move at all). And once at the dock, a standard boat trailer is unlikely to accommodate a ballasted boat (for economy, boat trailers are manufactured to support the dry weight of the boat, not the ballasted weight). The frame, suspension, and tires of a boat trailer rated for a 5,600 pound watercraft are unlikely to safely and successfully support one that suddenly weighs over 10,000 pounds. Getting the boat safely on its trailer, and safely out of the water, may have to wait until the ballast can finish being emptied.

If the time necessary to drain the ballast exceeds that permitted by an emergency, the consequences may be dire indeed for people and equipment alike. Improved apparatus and methods for rapidly draining the ballast compartments of a watercraft are of significant value in terms of both convenience and safety.

Another aspect of watercraft ballasting is the time required to initially fill, and later adjust, the ballast compartments. Modern wakeboats can require ten minutes or more to fill their enormous ballast compartments. The time thus wasted is one of the single most frequent complaints received by wakeboat manufacturers. Improved apparatus and methods that reduce the time necessary to prepare the ballast system for normal operation are of keen interest to the industry.

Yet another aspect of watercraft ballasting is the time required to make adjustments to the levels in the various ballast compartments. Consistency of the wake is of paramount importance, both for professional wakesport athletes and casual participants. Even small changes in weight distribution aboard the vessel can affect the resulting wake behind the hull; a single adult changing seats from one side to the other has a surprising effect. Indeed, rearranging such "human ballast" is a frequent command from wakeboat operators seeking to maintain the wake. A 150 pound adult moving from one side to the other represents a net 300 pound shift in weight distribution. The wakeboat operator must compensate quickly for weight shifts to maintain the quality of the wake.

The 800 GPH ballast pump mentioned above moves (800/60=) 13.3 gallons per minute, which at 8.34 pounds per gallon of water is 111 pounds per minute. Thus, offsetting the movement of the above adult would take (150/111=) 1.35 minutes. That is an exceedingly long time in the dynamic environment of a wakeboat; it is very likely that other changes will occur during the time that the operator is still working to adjust for the initial weight shift.

This inability to react promptly gives the wakeboat operator a nearly impossible task: Actively correct for very normal and nearly continuous weight shifts using slow water pumps, while still safely steering the wakeboat, while still monitoring the safety of the athlete in the wake, while still monitoring the proper operation of the engine and other systems aboard the vessel.

In addition to all of the other advantages, improved apparatus and methods that can provide faster compensation for normal weight shifts is of extreme value to watercraft owners and, thus, to watercraft manufacturers.

Another consideration for watercraft ballast systems is that correcting for weight shifts is not just a matter of pumping a single ballast compartment. The overall weight of the vessel has not changed; instead, the fixed amount of weight has shifted. This means an equivalent amount of ballast must be moved in the opposite direction—without changing the overall weight. In the "moving adult" example, 150 pounds of water must be drained from one side, and 150 pounds of water must be added to the other side, while maintaining the same overall weight of the wakeboat. This means TWO ballast pumps must be operating simultaneously.

Interviews with industry experts and certified professional wakeboat drivers reveal that correcting for a typical weight shift should take no more than 5-10 seconds. Based on the 150 pound adult example, that means (150/8.34=) 18 gallons of water must be moved in 5-10 seconds. To achieve that, each water pump in the system must deliver 6500 to 13,000 GPH. That is 4-8 times more volume than the wakeboat industry's standard ballast pumps described above.

The fact that today's ballast pumps are 4-8 times too small illustrates the need for an improved, high volume wakeboat ballast system design.

One reaction to "slow" ballast pumps may be "faster" ballast pumps. In water pump technology "more volume per unit time" means "larger", and, indeed, ever larger ballast pumps have been tried in the watercraft industry. One example of a larger electric ballast pump is the Rule 209B (Xylem Flow Control, 1 Kondelin Road, Cape Ann Industrial Park, Gloucester Mass. 01930, United States), rated by its manufacturer at 1600 GPH. Strictly speaking the Rule 209B is intended for livewell applications, but in their desperation for increased ballast pumping volume, watercraft manufacturers have experimented with a wide range of electric water pumps.

The Rule 209B's 1600 GPH rating is fully twice that of the Tsunami T800 (800 GPH) cited earlier. Despite this doubling of volume, the Rule 209B and similarly rated pumps fall far short of the 6500 to 13,000 GPH required—and their extreme electrical requirements begin to assert themselves.

As electric ballast pumps increase in water volume and size, they also increase in current consumption. The Rule 209B just discussed draws 10 amperes from standard 13.6V wakeboat electrical power. This translates to 136 watts, or 0.18 horsepower (HP). Due to recognized mechanical losses of all mechanical devices, not all of the consumed power results in useful work (i.e. pumped water). A great deal is lost to waste heat in water turbulence, I2R electrical losses in the motor windings, and the motor bearings to name just a few.

At the extreme end of the 12 VDC ballast pump spectrum are water pumps such as the Rule 17A (Xylem Flow Control, 1 Kondelin Road, Cape Ann Industrial Park, Gloucester Mass. 01930, United States), rated by its manufacturer at a sizable (at least for electric water pumps) 3800 GPH. To achieve this, the Rule 17A draws 20 continuous amperes at 13.6V, thus consuming 272 electrical watts and 0.36 HP. It is an impressive electrical ballast pump by any measure.

Yet, even with this significant electrical consumption, it would require two separate Rule 17A pumps running in parallel to achieve even the minimum acceptable ballast flow of 6500 GPH. And doing so would require 40 amperes of current flow. Duplicate this for the (at least) two ballast compartments involved in a weight shift compensation as described above, and the wakeboat now has 80 amperes of current flowing continuously to achieve the low end of the acceptable ballast flow range.

80 amperes is a very significant amount of current. For comparison, the largest alternators on watercraft engines are rated around 1200 W of output power, and they need to rotate at approximately 5000 RPM to generate that full rated power. Yet here, to achieve the minimum acceptable ballast flow range, four ballast pumps in the Rule 17A class would consume (4×272 W=) 1088 W. Since most watercraft engines spend their working time in the 2000-3000 RPM range, it is very likely that the four Rule 17A class water pumps would consume all of the alternator's available output—with the remainder supplied by the vessel's batteries. In other words, ballasting operations would likely be a drain on the boat's batteries even when the engine is running; never a good idea when the boat's engine relies on those batteries to be started later that day.

If the watercraft's engine is not running, then those 80 continuous amperes must be supplied by the batteries alone. That is an electrical demand that no watercraft battery bank can sustain safely, or for any length of time.

Even larger electric ballast pumps exist such as those used on yachts, tanker ships, container ships, and other ocean-going vessels. The motors on such pumps require far higher voltages than are available on the electrical systems of watercrafts. Indeed, such motors often require three phase AC power which is commonly available on such large vessels. These enormous electric ballast pumps are obviously beyond the mechanical and electrical capacities of watercrafts, and no serious consideration can be given to using them in this context.

The problem of moving enough ballast water fast enough is, simply, one of power transfer. Concisely stated, after accounting for the electrical and mechanical losses in various parts of the ballast system, about 2 HP is required to move the 6500-13,000 GPH required by each ballast pump. Since two pumps must operate simultaneously to shift weight distribution without changing total weight, a total of 4 horsepower must be available for ballast pumping.

4 HP is approximately 3000 watts, which in a 13.6 VDC electrical system is 220 continuous amperes of current flow. To give a sense of scale, the main circuit breaker serving an entire modern residence is generally rated for only 200 amperes.

In addition to the impracticality of even achieving over two hundred continuous amperes of current flow in a watercraft environment, there is the enormous expense of components that can handle such currents. The power cabling alone is several dollars per foot. Connectors of that capacity are enormously expensive, as are the switches, relays, and semiconductors to control it. And all of these components must be scaled up to handle the peak startup, or "in-rush", current that occurs with inductive loads such as electric motors, which is often twice or more the continuous running current.

Then there is the safety issue. Circuits carrying hundreds of amps running around on a consumer watercraft is a dangerous condition. That much current flow represents almost a direct short across a lead-acid battery, with all of the attendant hazards.

Moving large volumes of ballast water is a mechanical activity requiring mechanical power. To date, most watercraft ballast pumping has been done using electric ballast pumps. But as the above discussion makes clear, electricity is not a viable method for conveying the large amounts of power necessary to achieve the required pumping volumes.

The conversion steps starting with the mechanical energy of the engine, motor, or other prime mover on the vessel (hereinafter "engine" for brevity), then to electrical energy, and then finally back to mechanical energy that actually moves the water, introduces far too many inefficiencies, hazards, costs, and impracticalities when dealing with multiple horsepower. Part of the solution must thus be apparatus and methods of more directly applying the mechanical energy of the engine to the mechanical task of moving ballast water, without the intermediate electrical conversions common to the watercraft industry.

Some boat designs use two forward facing scoops to fill its ballast compartments, and two rear facing outlets to drain its ballast compartments, relying on forward motion of the boat as driven by the engine.

These designs suffer from several distinct and potentially dangerous disadvantages. Chief among these is the absolute dependency on boat motion to drain water from the ballast compartments. If the boat cannot move forward at a sufficient velocity to activate the draining operation ("on plane", generally at least 10 MPH depending on hull design), the ballast compartments literally cannot be drained.

There are countless events and mishaps that can make it impossible to propel the boat with sufficient velocity to activate such passive draining schemes. Striking a submerged object—natural or artificial—can damage the propeller, or the propeller shaft, or the propeller strut, or the outdrive. Damage to the rudder can prevent straightline motion of sufficient speed. Wrapping a rope around the propshaft or propeller can restrict or outright prevent propulsion. Damage to the boat's transmission or v-drive can also completely prevent movement. The engine may be running fine, yet due to problems anywhere in the various complex systems between the engine and the propeller, the boat may be unable to move fast enough to drain ballast—if it can move at all.

As noted earlier, being stranded in the water while unable to drain the ballast can be a life-threatening situation. A ballasted boat is just that much more difficult and time consuming to manually paddle (or tow with another boat) back to the dock. And as further noted above, once back to the dock it is very likely that the boat's trailer cannot pull the boat out of the water until some alternative, emergency method is found to remove the thousands of pounds of additional ballast.

Another disadvantage of such "passive" schemes is that they are incapable of actively pressurizing the water; they rely solely on the pressure caused by the forward motion of the boat. To compensate for such low pressure, unusually large inlet and outlet orifices with associated large water valves (often 3-4 inches in diameter) must be used to allow sufficient volumes of water to flow at such low pressures. The cost, maintenance, and reliability of such enormous valves is a known and continuing challenge.

The present disclosure provides apparatus and methods for filling, moving, and draining ballast compartments using the mechanical power of the engine. The apparatus and methods can provide this filling, moving and draining without intermediate electrical conversion steps, and/or while not requiring the hull to be in motion.

One embodiment of the present disclosure uses mechanical coupling, or "direct drive", to transfer power to one or more ballast pumps that are mounted directly to the engine. The power coupling may be via direct shaft connection, gear drive, belt or chain drive, or another manner that suits the specifics of the application.

A block diagram of an engine mounted, direct drive ballast pump is shown in FIG. 2. In this embodiment, engine power is conveyed to the pump via the engine's belt/chain. In other embodiments, engine power can be conveyed via direct crankshaft drive, gear drive, the addition of secondary pulleys/gears and an additional belt/chain, or other techniques.

Figure 2B:
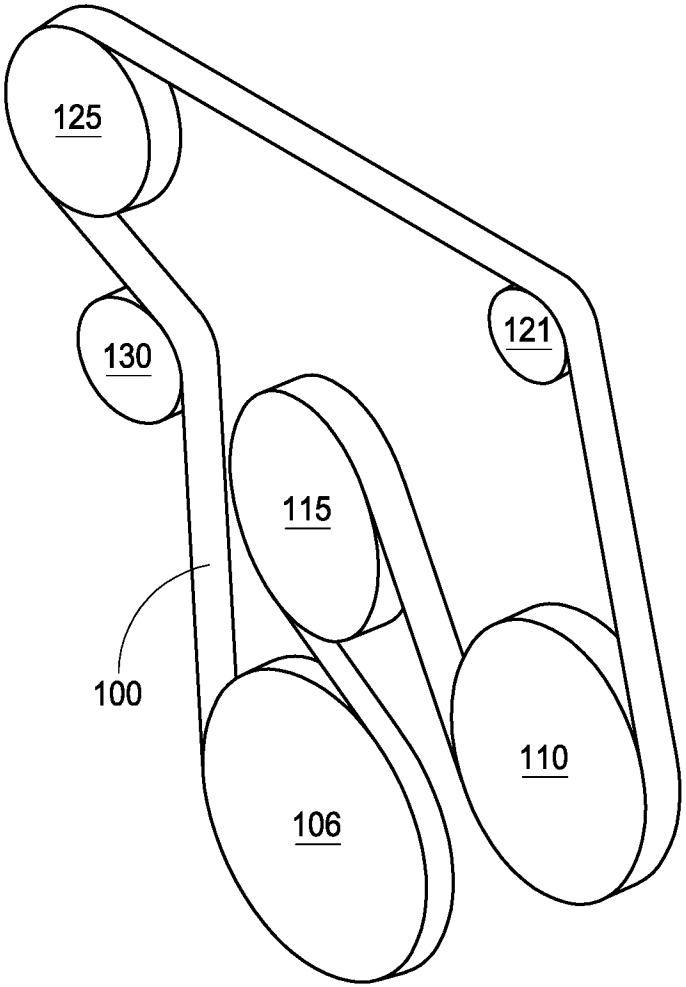
FIGS. 2A-2B illustrate example routings of a serpentine belt or chain on an engine, and on an engine with the addition of a direct drive ballast pump in keeping with one embodiment of the present disclosure.
Figure 2A:
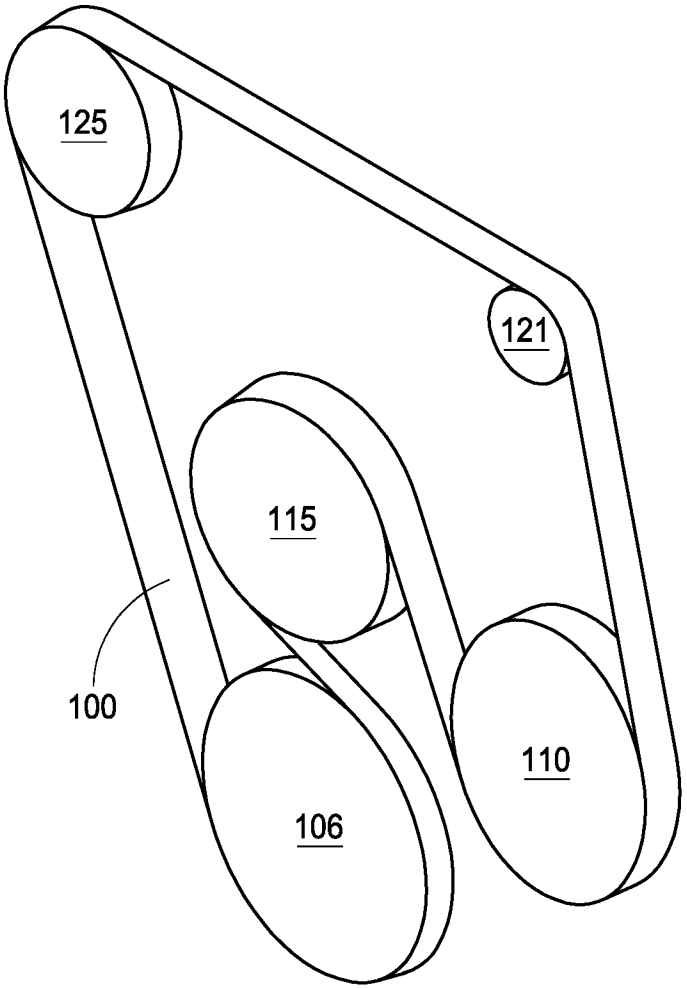

FIG. 2 shows the pulleys/gears and belt/chain that might be present on a typical watercraft engine. In FIG. 2A, belt/chain 100 passes around crankshaft pulley/gear 106, which is driven by the engine and conveys power to belt/chain 100. Belt/chain 100 then conveys engine power to accessories on the engine by passing around pulleys/gears on the accessories. Such powered accessories may include, for example, an alternator 110, a raw water pump 115, and a circulation pump 125. A belt/chain tensioner 121 maintains proper belt/chain tension. The arrangement of accessories and their pulleys/gears in the figures is for example purposes only; many other configurations are possible and compatible with the present disclosure.

FIG. 2B depicts how belt/chain 100 might be rerouted with the addition of direct drive ballast pump 130. Belt/chain 100 still provides engine power to all of the other engine mounted accessories as before, and now also provides engine power to ballast pump 130 via its pulley/gear.

A longer belt/chain may be necessary to accommodate the additional routing length of the ballast pump pulley/gear. The ballast pump and its pulley/gear may also be installed in a different location than that shown in FIG. 2B depending upon the engine, other accessories, and available space within the engine compartment. In some embodiments, the engagement or "wrap" angle of belt 100 is 60 degrees or more of the pulley/gear associated with pump 130 to reduce the potential for slippage.

Most such engine accessories are mounted on the "engine side" of their pulleys/gears. However, an alternative mounting technique, practiced in other configurations, mounts the body of the ballast pump on the opposite side of its pulley/gear 130, away from the engine itself, while keeping its pulley/gear in line with the belt/chain and other pulleys/gears. Modern marine engines are often quite tightly packaged with very little free space within their overall envelope of volume. This alternative mounting technique can provide extra engine accessories, such as the engine powered pumps of the present disclosure, to be added when otherwise no space is available. In some embodiments such engine powered pumps may have a clutch associated with pulley/gear 132, for reasons described later herein.

Certain other embodiments mount the ballast pump away from the engine for reasons including convenience, space availability, or serviceability. In such remote mounted embodiments the aforementioned belt/chain or shaft drives may still be used to convey mechanical power from the engine to the pump. Alternately, another power conveyance technique may be used such as a flexible shaft; connection to Power Take Off (PTO) point on the engine, transmission, or other component of the drivetrain; or another approach as suitable for the specifics of the application.

A suitable direct drive ballast pump can be engine driven and high volume. An example of such a pump is the Meziere WP411 (Meziere Enterprises, 220 South Hale Avenue, Escondido Calif. 92029, United States). The WP411 is driven by the engine's belt/chain just as other accessories such as the cooling pump and alternator, thus deriving its motive force mechanically without intermediate conversion steps to and from electrical power.

The WP411 water pump can move up to 100 GPM, but requires near-redline engine operation of about 6500 RPM to do so. At a typical idle of 650 RPM (just 10% of the aforementioned requirement), the WP411 flow drops to just 10 GPM.

In other vehicular applications, this high RPM requirement might not present a problem as the velocity can be decoupled from the engine RPM via multiple gears, continuously variable transmissions, or other means. But in a watercraft application, the propeller RPM (and thus hull speed) is directly related to engine RPM. Watercraft transmissions and v-drives are fixed-ratio devices allowing forward and reverse propeller rotation at a fixed relationship to the engine RPM. Thus to achieve the design performance of a water pump such as the WP411, it must be permissible to run the engine at maximum (also known as "wide open throttle", or WOT). This means either travelling at maximum velocity, or having the transmission out of gear and running the engine at WOT while sitting still in the water.

These extremes—sitting still or moving at maximum speed—are not always convenient. If the goal is to move the ballast at 100 GPM while the watercraft is under normal operation (i.e. travelling at typical speeds at typical mid-range engine RPM's), then the ballast pump(s) must be increased in size to provide the necessary GPM at those lower engine RPM's. And if, as is very often the case, the ballast is to be filled or drained while at idle (for example, in no-wake zones), then the ballast pump(s) can experience an RPM ratio of 10:1 or greater. This extreme variability of engine RPM and its direct relationship to direct-drive ballast pump performance forces compromises in component cost, size, and implementation.

To accommodate these range-of-RPM challenges, some embodiments of the present disclosure use a clutch to selectively (dis)connect the engine belt/chain pulley/gear to the ballast pump(s). An example of such a clutch is the Warner Electric World Clutch for Accessory Drives (Altra Industrial Motion, 300 Granite Street, Braintree Mass. 02184, United States). The insertion of a clutch between the belt/chain pulley/gear and the ballast pump allows the ballast pump to be selectively powered and depowered based on pumping requirements, thereby minimizing wear on the ballast pump and load on the engine. A clutch also permits the ballast pump to be decoupled if the engine's RPM exceeds the rating of the ballast pump, allowing flexibility in the drive ratio from engine to ballast pump and easing the challenge of sizing the ballast pump to the desired RPM operational range in fixed-ratio watercraft propulsion systems.

Direct drive ballast pumps thus deliver a substantial improvement over the traditional electrical water pumps discussed earlier. In accordance with example implementations, these pumps may achieve the goals of 1) using the mechanical power of the engine, 2) eliminating intermediate electrical conversion steps, and/or 3) not requiring the hull to be in motion.

However, the direct-coupled nature of direct drive ballast pumps makes them susceptible to the RPM's of the engine on a moment by moment basis. If direct drive ballast pumps are sized to deliver full volume at maximum engine RPM, they may be inadequate at engine idle. Likewise, if direct drive ballast pumps are sized to deliver full volume at engine idle, they may be overpowerful at higher engine RPM's, requiring all components of the ballast system to be overdesigned.

Another difficulty with direct drive ballast pumps is the routing of hoses or pipes from the ballast chambers. Requiring the water pumps to be physically mounted to the engine forces significant compromises in the routing of ballast system plumbing. Indeed, it may be impossible to properly arrange for ballast compartment draining if the bottom of a compartment is below the intake of an engine mounted ballast pump. Pumps capable of high volume generally require positive pressure at their inlets and are not designed to develop suction to lift incoming water, while pumps which can develop inlet suction are typically of such low volume that do not satisfy the requirements for prompt ballasting operations.

Further improvement is thus desirable, to achieve the goals of the present disclosure while eliminating 1) the effect of engine RPM on ballast pumping volume, and/or 2) the physical compromises of engine mounted water pumps. Some embodiments of the present disclosure achieve this, without intermediate electrical conversion steps, by using one or more direct drive hydraulic pumps to convey mechanical power from the engine to remotely located ballast pumps.

Just because hydraulics are involved may not eliminate the need for ballast pumping power to emanate from the engine. For example, small hydraulic pumps driven by electric motors have been used on some watercrafts for low-power applications such as rudder and trim plate positioning. However, just as with the discussions regarding electric ballast pumps above, the intermediate conversion step to and back from electrical power exposes the low-power limitations of these electrically driven hydraulic pumps. Electricity remains a suboptimal way to convey large amounts of mechanical horsepower for pumping ballast.

For example, the SeaStar AP1233 electrically driven hydraulic pump (SeaStar Solutions, 1 Sierra Place, Litchfield Ill. 62056, United States) is rated at only 0.43 HP, despite being the largest of the models in the product line. Another example is the Raymarine ACU-300 (Raymarine Incorporated, 9 Townsend West, Nashua N.H. 03063, United States) which is rated at just 0.57 HP, again the largest model in the lineup. These electrically driven hydraulic pumps do an admirable job in their intended applications, but they are woefully inadequate for conveying the multiple horsepower necessary for proper watercraft ballast pumping.

As with electric ballast pumps, even larger electrically driven hydraulic pumps exist such as those used on yachts, tanker ships, container ships, and other ocean-going vessels. The motors on such pumps run on far higher voltages than are available on watercrafts, often requiring three phase AC power which is commonly available on such large vessels. These enormous electrically driven hydraulic pumps are obviously beyond the mechanical and electrical capacities of watercrafts, and no serious consideration can be given to using them in this context.

To overcome the above limitations, embodiments of the present disclosure may add one or more hydraulic pumps, mounted on and powered by the engine. The resulting direct drive provides the hydraulic pump with access to the engine's high native horsepower via the elimination of intermediate electrical conversions. The power coupling may be via shaft connection, gear drive, belt/chain drive, or another manner that suits the specifics of the application.

Referring back to the belt/chain drive approach of FIGS. 2A and 2B reveals one technique of many for powering a hydraulic pump from the engine of a watercraft. In some embodiments, the hydraulic pump can be powered by pulley/gear 130 of FIG. 2B and thus extract power from the engine of the watercraft via the belt/chain used to power other accessories already on the engine.

As mentioned previously, pumps associated with the present disclosure may be optionally installed to access an engine's accessory drive belt/chain, with a pulley/gear engaging the belt/chain to obtain power from the engine. As noted, however, modern marine engines are often quite tightly packaged with very little free space within their overall envelope of volume.

Tensioner 121 of FIG. 2A maintains tension on the belt/chain. In addition to the techniques described earlier herein, some embodiments of the present disclosure integrate tensioner 121 with the pump itself. The resulting assembly may be mounted on a spring, sliding-slot, or other adjustment mechanism much like a traditional standalone tensioner, so that the tensioning function may be duplicated by the pulley/gear of the pump. In this manner the volume required by the pump(s) of the present disclosure can repurpose or share the volume otherwise occupied by an existing engine accessory—in this example, tensioner 121.

Figure 3:
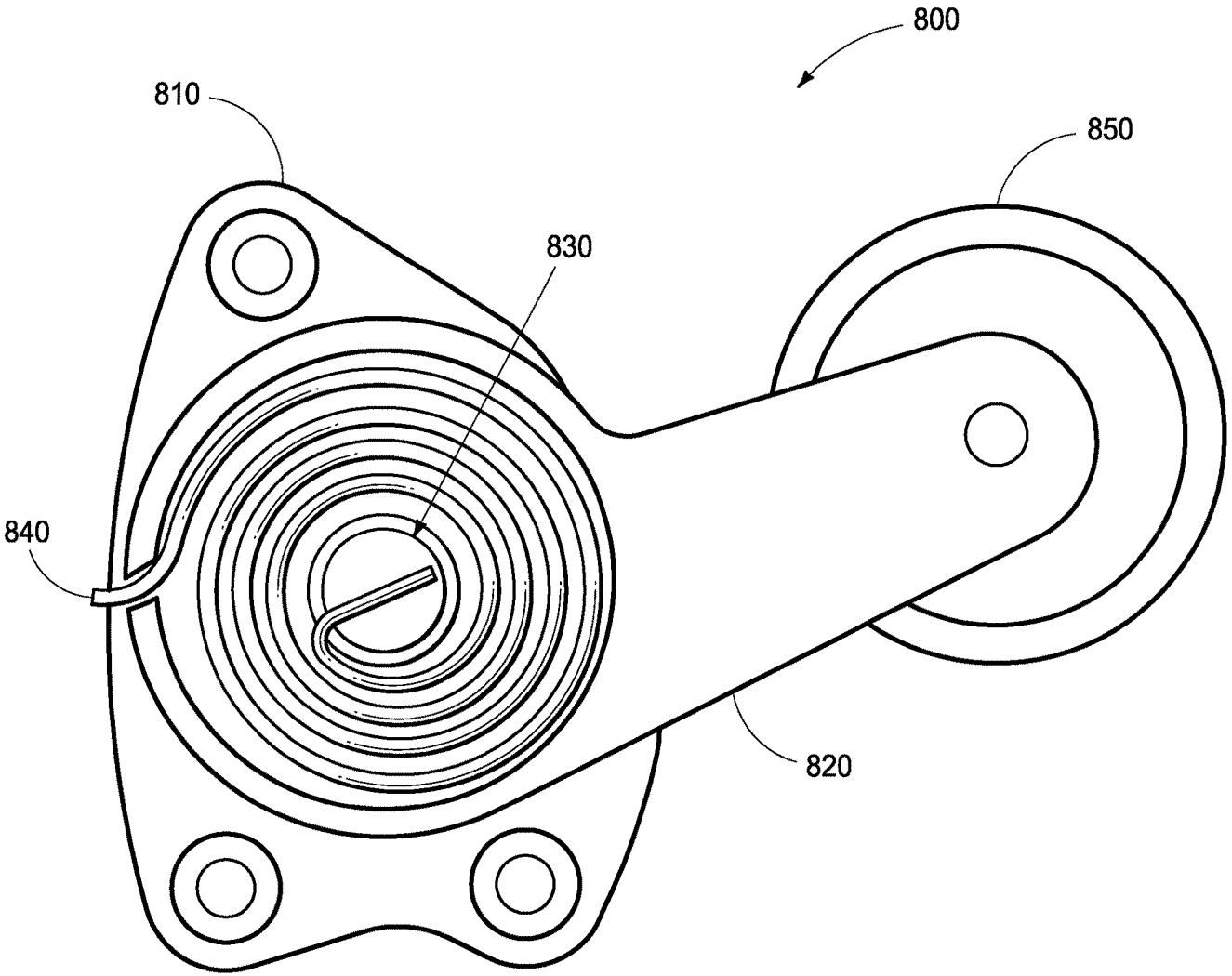
FIG. 3 illustrates one example of a belt/chain tensioner.

For example, FIG. 3 illustrates a tensioner assembly 800. Assembly 800 can include mounting plate 810 configured to attach the tensioner to the engine block or other location, often specified by the engine manufacturer. Tension arm 820 can be pivotally mounted to mounting plate 810 at pivot 830. Tension spring 840 can provide rotation resistance to tension arm 820 with respect to mounting plate 810. Pulley/gear 850 can be rotatably mounted to tension arm 820.

In use, tensioner assembly 800 of FIG. 3 may engage the belt/chain via pulley/gear 850. Installation of the belt/chain around pulley/gear 850 may be accomplished by rotating tension arm 820 around pivot 830, which may also tighten tension spring 840. Once the belt/chain is engaged by pulley/gear 850, rotation may be relaxed on tension arm 820 which may allow tension spring 840 to maintain pressure on the belt/chain. This configuration may take up slack in the system for example.

Mounting plate 810, and the location to which it attaches, can establish a mechanical mounting interface. Some embodiments may duplicate the mounting interface of the engine accessory which may be integrated with the pump(s) of the present disclosure. Doing so may minimize alterations required to render the combined accessory compatible with existing engines. The resulting compatibility may allow easier integration of some embodiments into existing engine designs, easing the inclusion of the present disclosure into new watercrafts. Additionally, this physical compatibility may provide for retrofitting existing watercraft.

In some embodiments the fluidic connections to pump(s) combined with other engine accessories may be flexible, such as hydraulic hoses, so the movement inherent to the operation of the tensioner is accommodated by said flexible connections.

Figure 4:
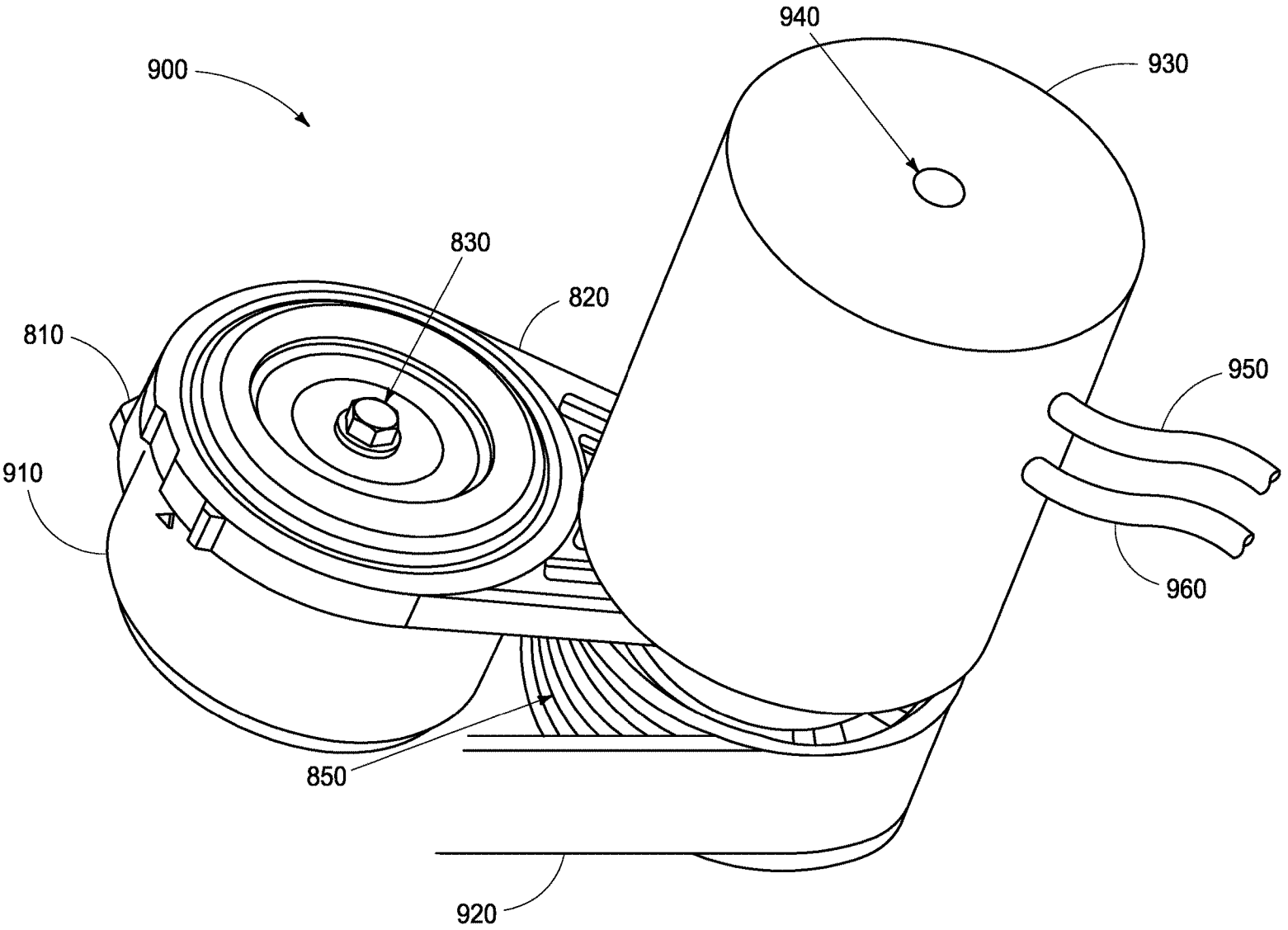
FIG. 4 illustrates a combined hydraulic pump and belt/chain tensioner according to an embodiment of the disclosure.

FIG. 4 illustrates an example pump-tensioner assembly 900 that may be implemented as a belt-and-pulley configuration combining a pump 930 with a belt/chain tensioner assembly 800 as used by some embodiments of the present disclosure. Mounting plate 810 is compatible with the physical interface of tensioner assemblies. Housing 910 may enclose tension spring 840 (shown for example in FIG. 3); some tensioner designs have enclosed spring(s), others do not. Tension arm 820 may rotate around pivot 830. Pulley 850 may be rotatably mounted to tension arm 820, and engage belt 920. In some embodiments the engagement or "wrap" angle of belt 920 is 60 degrees or more around pulley 850 to minimize slippage.

Continuing with FIG. 4, pump 930 may be mounted to tension arm 820. Shaft 940 of pump 930 may be connected to pulley 850 and configured that when pulley 850 is rotated by belt 920, pump 930 is also rotated. Pump 930 may be driven by belt 920. Hydraulic fluid may be conveyed to and from pump 930 by conduits 950 and 960, which are shown in FIG. 4 as flexible hydraulic hoses to accommodate the motion of pump 930 during pivoting of tension arm 820 during both belt/chain installation and normal tensioning movement during operation.

Example embodiments such as those demonstrated in FIG. 4 thus may take advantage of the existing mounting hardware, pulley/gear, and other aspects of existing engine accessories. The pump(s) of some embodiments thus need not find their own available mounting location, nor space for their own pulley/gear. In some embodiments even the length of the belt/chain need not change: The factory original belt/chain may be used because the size and location of the pulley/gear has not been altered which saves money, reduces stockroom complexity, and further eases integration into new and existing watercraft designs.

FIG. 4 further illustrates hydraulic pump 930 to the "outside" (the side opposite mounting plate 810) of the tensioner. As noted above, modern marine engines are often quite tightly packaged with very little free space within their overall envelope of volume. The mounting of pump 930 outside this envelope allows some embodiments to derive power from the belt/chain with minimal impact on the overall arrangement of the engine and its accessories. Other embodiments may optionally locate pump 930 on the same side as mounting plate 810, along the length of tension arm 820 with a suitable shaft coupling, or another configuration as is suited to the specifics of the application.

In some embodiments the diameter of pulley/gear 850 may be kept the same as the original engine accessory. In other embodiments, the diameter of pulley/gear 850 may be changed to alter the drive ratio between belt/chain velocity and the RPM experienced by pump 930.

As noted above, this technique is not limited to just tensioner 121. Other embodiments of this technique may comprise integrating the pump(s) with different engine accessories such as alternators, cooling or circulation pumps, air conditioning compressors, and the like. Candidates for this technique may include engine-powered accessories where the volume consumed, and/or the communication of power from the engine, may be at least partially combined or shared to reduce overall complexity, reduce overall volume, physically rearrange the components to better use available space, and realize other advantages specific to the application.

Some other embodiments mount the hydraulic pump away from the engine for reasons including convenience, space availability, or serviceability. In such remote mounted embodiments the aforementioned belt/chain or shaft drives may still be used to convey mechanical power from the engine to the pump. Alternately, another power conveyance technique may be used such as a flexible shaft; connection to Power Take Off (PTO) point on the engine, transmission, or other component of the drivetrain; or another approach as suitable for the specifics of the application.

One example of such a direct drive hydraulic pump is the Parker Gresen PGG series (Parker Hannifin Corporation, 1775 Logan Avenue, Youngstown Ohio 44501, United States). The shaft of such hydraulic pumps can be equipped with a pulley, gear, direct shaft coupling, or other connection as suits the specifics of the application.

The power transferred by a hydraulic pump to its load is directly related to the pressure of the pumped hydraulic fluid (commonly expressed in pounds per square inch, or PSI) and the volume of fluid pumped (commonly expressed in gallons per minute, or GPM) by the following equation:

$$HP=((PSI\times GPM)/1714)$$

The conveyance of a certain amount of horsepower can be accomplished by trading off pressures versus volumes. For example, to convey 2 HP to a ballast pump as discussed earlier, some embodiments may use a 1200 PSI system. Rearranging the above equation to solve for GPM:

$$((2\ HP\times 1714)/1200\ PSI)=2.86\ GPM$$

and thus a 1200 PSI system would require a hydraulic pump capable of supplying 2.86 gallons per minute of pressurized hydraulic fluid for each ballast pump that requires 2 HP of conveyed power.

Other embodiments may prefer to emphasize hydraulic pressure over volume, for example to minimize the size of the hydraulic pumps and motors. To convey the same 2 HP as the previous example in a 2400 PSI system, the equation becomes:

$$((2\ HP\times 1714)/2400\ PSI)=1.43\ GPM$$

and the components in the system would be resized accordingly.

A significant challenge associated with direct mounting of a hydraulic pump on a gasoline marine engine is RPM range mismatch. For a variety of reasons, the vast majority of watercrafts use marinized gasoline engines. Such engines have an RPM range of approximately 650-6500, and thus an approximate 10:1 range of maximum to minimum RPM's.

Hydraulic pumps are designed for an RPM range of 600-3600, or roughly a 6:1 RPM range. Below 600 RPM a hydraulic pump does not operate properly. The 3600 RPM maximum is because hydraulic pumps are typically powered by electric motors and diesel engines. 3600 RPM is a standard rotational speed for electric motors, and most diesel engines have a maximum RPM, or "redline", at or below 3600 RPM.

A maximum RPM of 3600 is thus not an issue for hydraulic pumps used in their standard environment of electric motors and diesel engines. But unless the mismatch with high-revving gasoline engines is managed, a watercraft engine will likely overrev, and damage or destroy, a hydraulic pump.

Some embodiments of the present disclosure restrict the maximum RPM's of the watercraft engine to a safe value for the hydraulic pump. However, since propeller rotation is directly linked to engine RPM, such a so-called "rev limiter" would also reduce the top-end speed of the watercraft. This performance loss may be unacceptable to many manufacturers and owners alike.

Other embodiments of the present disclosure can reduce the drive ratio between the gasoline engine and the hydraulic pump, using techniques suited to the specifics of the application. For example, the circumference of the pulley/gear for a hydraulic pump driven via a belt/chain can be increased such that the hydraulic pump rotates just once for every two rotations of the gasoline engine, thus yielding a 2:1 reduction. For an engine with a redline of 6500 RPM, the hydraulic pump would thus be limited to a maximum RPM of 3250. While halving the maximum engine RPM's would solve the hydraulic pump's overrevving risk, it would also halve the idle RPM's to below the hydraulic pump's minimum (in these examples, from 650 to 325) and the hydraulic pump would be inoperable when the engine was idling.

The loss of hydraulic power at engine idle might not be a problem on other types of equipment. But watercraft are often required to operate at "no wake speed", defined as being in gear (the propeller is turning and providing propulsive power) with the engine at or near idle RPM's. No wake speed is specifically when many watercraft need to fill or drain ballast, so an apparatus or method that cannot fill or drain ballast at no wake speeds is unacceptable.

Since most watercraft engines have an RPM range around 10:1, a solution is required for those applications where it is neither acceptable to rev-limit the engine nor lose hydraulic power at idle. A preferred technique should provide hydraulic power to the ballast pumps at engine idle, yet not destroy the hydraulic pump with excessive RPM's at full throttle.

Fortunately, sustained full throttle operation does not occur during the activities for which a watercraft is normally employed (wakesurfing, wakeboarding, waterskiing, kneeboarding, etc.). On a typical wakeboat, the normal speed range for actual watersports activities may be from idle to perhaps 30 MPH—with the latter representing perhaps 4000 RPM. That RPM range would be 650 to 4000, yielding a ratio of roughly 6:1—a ratio compatible with that of hydraulic pumps.

What is needed, then, is a way to "remove" the upper portion of the engine's 10:1 RPM range, limiting the engine RPM's to the 6:1 range of the hydraulic pump. To accomplish this, some embodiments of the present disclosure use a clutch-type device to selectively couple engine power to the hydraulic pump, and (more specifically) selectively decouple engine power from the hydraulic pump when engine RPM's exceed what is safe for the hydraulic pump. The clutch could be, for example, a Warner Electric World Clutch for Accessory Drives (Altra Industrial Motion, 300 Granite Street, Braintree Mass. 02184, United States) or another clutch-type device that is suitable for the specifics of the application.

The clutch of these embodiments of the present disclosure allows the "upper portion" of the engine's 10:1 range to be removed from exposure to the hydraulic pump. Once the RPM ranges are thus better matched, an appropriate ratio of engine RPM to hydraulic pump RPM can be effected through the selection of pulley diameters, gear ratios, or other design choices.

In addition to the integer ratios described earlier, non-integer ratios could be used to better match the engine to the hydraulic pump. For example, a ratio of 1.08:1 could be used to shift the watercraft engine's 650-4000 RPM range to the hydraulic pump's 600-3600 RPM range.

Accordingly, embodiments of the present disclosure may combine 1) a clutch's ability to limit the overall RPM ratio with 2) a ratiometric direct drive's ability to shift the limited RPM range to that required by the hydraulic pump. Hydraulic power is available throughout the entire normal operational range of the engine, and the hydraulic pump is protected from overrev damage. The only time ballast pumping is unavailable is when the watercraft is moving at or near its maximum velocity (i.e. full throttle), when watersports participants are not likely to be behind the boat. More importantly, ballast pumping is available when idling, and when watersports participants are likely to be behind the boat (i.e. not at full throttle).

Another advantage of this embodiment of the present disclosure is that the clutch may be used to selectively decouple the engine from the hydraulic pump when ballast pumping is not required. This minimizes wear on the hydraulic pump and the entire hydraulic system, while eliminating the relatively small, but nevertheless real, waste of horsepower that would otherwise occur from pressurizing hydraulic fluid when no ballast pumping is occurring.

Some embodiments that incorporate clutches use electrically actuated clutches, where an electrical signal selectively engages and disengages the clutch. When such electric clutches are installed in the engine or fuel tank spaces of a vessel, they often require certification as non-ignition, non-sparking, or explosion-proof devices. Such certified electric clutches do not always meet the mechanical requirements of the application.

To overcome this limitation, certain embodiments incorporate clutches that are actuated via other techniques such as mechanical, hydraulic, pneumatic, or other non-electric approach. A mechanically actuated clutch, for example, can be controlled via a cable or lever arm. A hydraulically or pneumatically clutch can be controlled via pressurized fluid or air if such is already present on the vessel, or from a small dedicated pump for that purpose if no other source is available.

The use of non-electrically actuated clutches relieves certain embodiments of the regulatory compliance requirements that would otherwise apply to electrical components in the engine and/or fuel tank spaces. The compatibility of the present disclosure with such clutches also broadens the spectrum of options available to Engineers as they seek to optimize the countless tradeoffs associated with watercraft design.

A further advantage to this embodiment of the present disclosure is that, unlike direct drive ballast pumps, the power conveyed to the remotely located ballast pumps can be varied independently of the engine RPM. The hydraulic system can be sized to make full power available to the ballast pumps even at engine idle; then, the hydraulic power conveyed to the ballast pumps can be modulated separately from engine RPM's to prevent overpressure and overflow from occurring as engine RPM's increase above idle. In this way, the present disclosure solves the final challenge of conveying full (but not excessive) power to the ballast pumps across the selected operational RPM range of the engine.

Some embodiments of the present disclosure may use "variable ratio" drive assemblies or systems to convey power to a hydraulic pump from the engine of a watercraft. Such variable ratio drive assemblies may be used together with, or instead of, the aforementioned decoupling clutch.

By way of example, one commonly known variable ratio drive assembly is a Continuously Variable Transmission (CVT) that has been used in terrain vehicles such as snowmobiles and/or golfcarts. Instead of discrete selectable gears (which provide a limited number of fixed drive ratios), CVT's smoothly change their drive ratios based on one or more parameters such as engine RPM, output RPM, vehicle speed, and/or power and/or torque demand. Changes to the drive ratio can be effected via centrifugal force; weights; springs; sensors; controls based on electronics, mechanics, hydraulics, and/or pneumatics; and any combination of these and/or other techniques. The goal of these traditional CVT applications is to smoothly couple an engine with variable RPM's to a vehicle axle whose RPM range may include zero.

In contrast, some embodiments of the present disclosure employ variable ratio drive assemblies for an entirely different purpose: To narrow, or normalize, the RPM range experienced by a hydraulic pump. As just one example, a variable ratio drive assembly may eliminate the need to decouple a hydraulic pump from the engine by narrowing the engine's natively wide RPM range to a narrower range more suited for input to a hydraulic pump.

As noted earlier herein, a watercraft engine may have an operational range of 650-6500 RPM (10:1) while a hydraulic pump may have an operational RPM range of 600-3600 (6:1). A variable ratio drive assembly of the present disclosure may adjust its ratio to normalize the engine RPM from its native 10:1 to the 6:1 required by a hydraulic pump without "removing" a portion of the engine's RPM range (and thus making hydraulic power unavailable at times).

In some embodiments, a variable ratio drive assembly may reduce the variability presented to the hydraulic pump to the point that hydraulic power (which is related to pump RPM) may be nearly constant regardless of engine RPM. At low engine RPM's the variable ratio drive assembly may use a "step-up" ratio above 1:1, and as engine RPM's increase the variable ratio drive assembly may transition to a "step-down" ratio below 1:1, thus normalizing to some extent the RPM's experienced by a hydraulic pump—and the power made available from that pump—regardless of engine speed.

Figure 5:
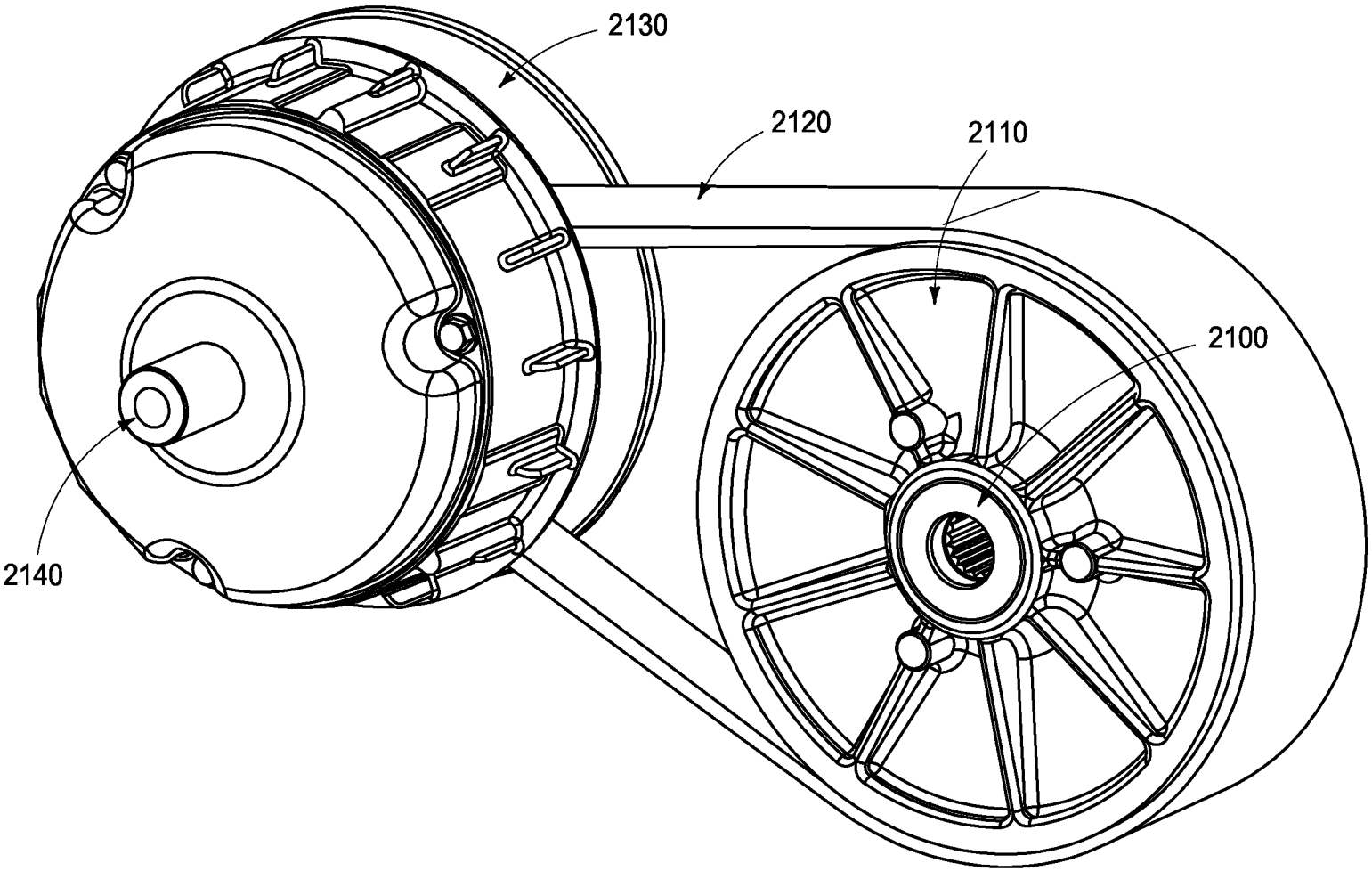
FIG. 5 illustrates at least one embodiment of a variable ratio drive assembly according to an embodiment of the disclosure.

As just one example, FIG. 5 illustrates one embodiment of a variable ratio drive assembly of the present disclosure that, at engine idle of (say) 650 RPM, uses a step-up ratio of 4.6:1. Input shaft 2100, driven by the engine at the present example of 650 RPM, turns driver pulley 2110 to move belt/chain 2120. At this lower engine RPM the effective diameter of driver pulley 2110 is adjusted to be relatively larger, thus increasing the linear velocity of belt/chain 2120.

Continuing with FIG. 5, the motion of belt/chain 2120 moves driven pulley 2130, whose effective diameter is adjusted inversely to that of driver pulley 2110 in accordance with the length of belt/chain 2120. As one pulley increases its effective diameter, the other reduces its effective diameter. Since at lower RPM's the effective diameter of driver pulley 2110 is larger, the effective diameter of driven pulley 2130 is smaller and output shaft 2140 is rotated faster than input shaft 2100.

The result, at low engine RPM, is a step-UP ratio that rotates driven pulley 2130 faster than driver pulley 2110. In the present example, the target ratio at an input RPM of 650 may be approximately 4.6:1, meaning that at engine idle, a hydraulic pump would then see input RPM's of (650×4.6=) approximately 3000 RPM, comfortably near the top of its RPM range.

As engine RPM's increase the variable ratio drive assembly may transition to lower drive ratios, until at maximum RPM's of (say) 6500 the variable ratio drive assembly may use a step-down ratio of (say) 0.46:1.

Figure 6:
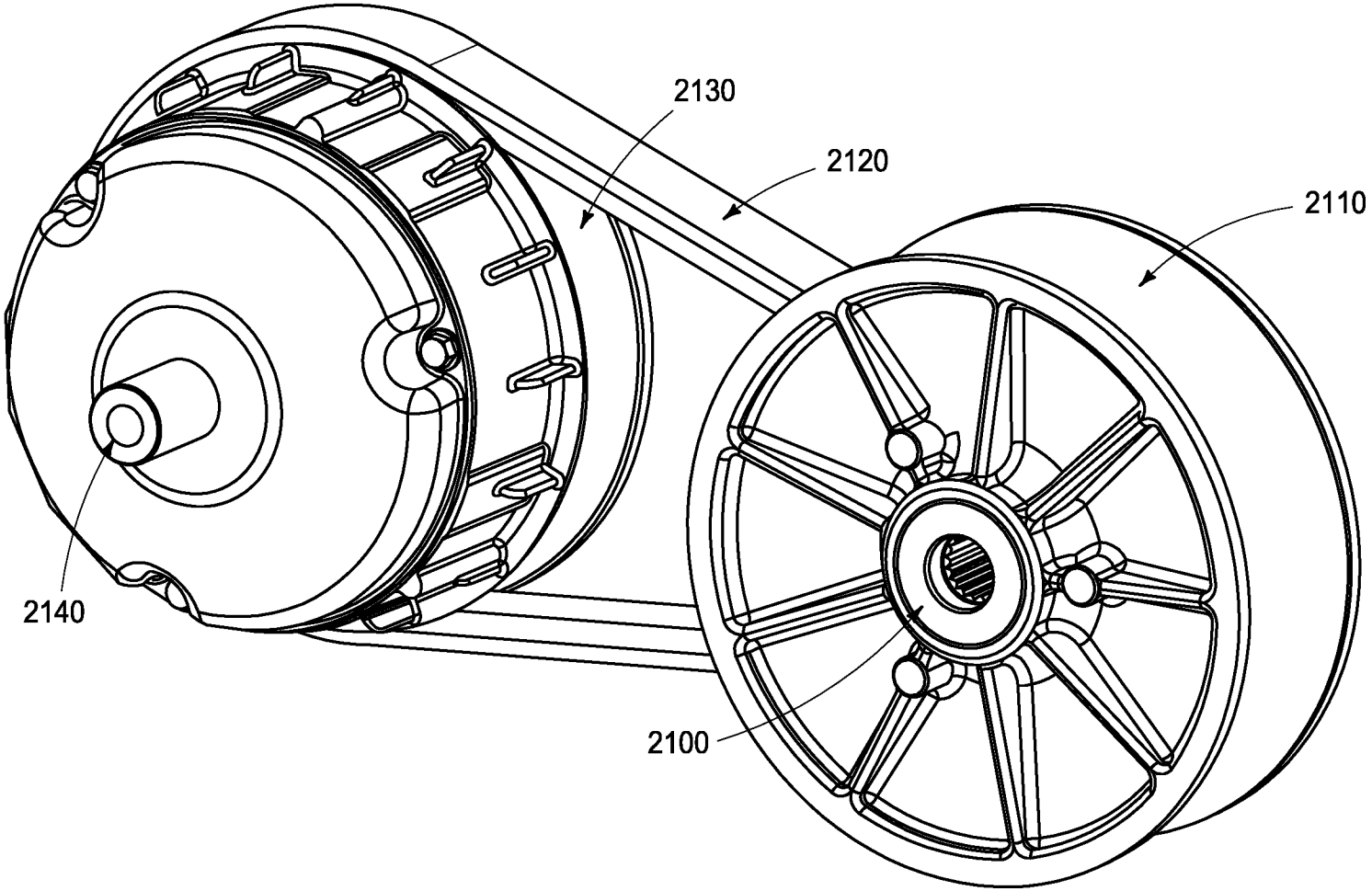
FIG. 6 illustrates at least one more embodiment of a variable ratio drive assembly according to an embodiment of the disclosure.

FIG. 6 illustrates this mode of operation for some embodiments of the disclosure. Input shaft 2100, driven by the engine at its redline RPM of 6500, again turns driver pulley 2110 to move belt/chain 2120. At this higher engine RPM the effective diameter of driver pulley 2110 is adjusted to be relatively smaller, thus decreasing the linear velocity of belt/chain 2120 compared with the low/idle engine RPM operating mode of FIG. 5.

Continuing with FIG. 6, the motion of belt/chain 2120 moves driven pulley 2130. Since at higher RPM's the effective diameter of driver pulley 2110 is smaller, the effective diameter of driven pulley 2130 is larger and output shaft 2140 is rotated slower than input shaft 2100.

Thus at high engine RPM, a step-DOWN ratio rotates driven pulley 2130 slower than driver pulley 2110. In the present example, the target ratio at an input RPM of 6500 may be approximately 0.46:1, meaning that at engine redline, a hydraulic pump would see RPM's of (6500×0.46=) approximately 3000 RPM—roughly the same RPM's as at engine idle.

FIG. 5 and FIG. 6 illustrate extremes of engine RPM range. A variable ratio drive assembly of the present disclosure may also accommodate intermediate engine RPM's, smoothly adjusting the drive ratio from input shaft 2100 to output shaft 2140 to provide more consistent RPM's to a hydraulic pump.

Indeed, in some embodiments the hydraulic pump may see a nearly constant input RPM regardless of engine RPM. If that nearly constant pump RPM is held near the maximum design speed of the pump, the hydraulic power available in the system is maximized regardless of the engine RPM. This means full hydraulic power is available at engine idle, engine redline, and in between.

Some embodiments of the present disclosure may incorporate data from other aspects of watercraft operation to selectively control the variable ratio drive assembly. One example, provided by some embodiments, may use hull velocity as an indication of the operational mode of the watercraft. When hull velocity is low or zero, certain hydraulically powered features may not be in use, meaning demands on the hydraulic pump driven by the variable ratio drive assembly may be reduced, and the variable ratio drive assembly may be selectively adjusted accordingly. Some embodiments may consider engine temperature, controlling the variable ratio drive assembly to modulate the power available to the hydraulic pump before the engine warms to its normal operating temperature. Some embodiments may consider demands upon the hydraulic system and modulate the variable ratio drive assembly to optimize the relationship between pressure and flow of the hydraulic oil/fluid out of the hydraulic pump.

Practical considerations may limit the ability of a variable ratio drive assembly in some embodiments to deliver truly constant RPM's to a hydraulic pump. In some embodiments, for example, there may be a modest dropoff at the end(s) of the engine's RPM range or the output RPM's may not be perfectly linear from idle to redline. Even so, the variable ratio drive assembly of the present disclosure can significantly improve the consistency of hydraulic performance and make some heretofore impractical applications possible.

Embodiments of the present disclosure are not limited to using two adjustable pulleys. Alternative techniques for achieving a variable drive ratio may also be applicable, even preferable, depending upon the specifics of the application. As just one example, a variable ratio drive assembly may comprise one pulley having a variable effective diameter and a second pulley having a traditional fixed diameter. The resulting changes in intershaft spacing as the drive ratio varies may be accommodated by mounting at least one of the pulleys on a support which moves the pulleys relative to each other to maintain appropriate belt tension.

Complete hydraulic systems may include additional components beyond those specifically discussed herein. Parts such as hoses, fittings, filters, reservoirs, intercoolers, pressure reliefs, and others have been omitted for clarity but such intentional omission should not be interpreted as an incompatibility nor absence. Such components can and will be included as necessary in real-world applications of the present disclosure.

Conveyance of the hydraulic power from the hydraulic pump to the ballast pumps need not be continuous. Indeed, most embodiments of the present disclosure will benefit from the ability to selectively provide power to the various ballast pumps in the system. One manner of such control, used by some embodiments, is hydraulic valves, of which there are many different types.

Some embodiments can include full on/full off valves. Other embodiments employ proportional or servo valves where the flow of hydraulic fluid, and thus the power conveyed, can be varied from zero to full. Valves may be actuated mechanically, electrically, pneumatically, hydraulically, or by other techniques depending upon the specifics of the application. Valves may be operated manually (for direct control by the operator) or automatically (for automated control by on-board systems). Some embodiments use valves permitting unidirectional flow of hydraulic fluid, while other embodiments use valves permitting selective bidirectional flow for those applications where direction reversal may be useful.

Valves may be installed as standalone devices, in which case each valve requires its own supply and return connections to the hydraulic pump. Alternatively, valves are often assembled into a hydraulic manifold whereby a single supply-and-return connection to the hydraulic pump can be selectively routed to one or more destinations. The use of a manifold often reduces the amount of hydraulic plumbing required for a given application. The present disclosure supports any desired technique of valve deployment.

A manifold of the present disclosure may comprise one or more hydraulic valves, and provision may be made for additional valves to be added to a manifold at a later time. For brevity, descriptions of manifolds herein may apply to manifolds with any number of hydraulic valves.

Hydraulic connections between a manifold and other components of the hydraulic system (such as filters, reservoirs, coolers, and the like) may include hose, hard tubing, fittings, direct attachment, and any other technique suited to the specifics of the application. In some embodiments multiple types of connections may be used to advantage depending upon component locations and distances.

In some embodiments, manifolds may comprise processing circuitry to selectively monitor and/or control one or more valves or other features. In some embodiments, manifolds may comprise one or more communication interfaces which enable selective communication with other manifolds, controllers, systems, modules, and/or devices. These interfaces may comprise one or more of the following: Controller Area Network (CAN), Local Interconnect Network (LIN), NMEA 2000 or similar, any of the various versions of Ethernet, analog voltages and/or currents, any other wired interfaces whether standard or proprietary, optical interfaces, and wireless (sometimes referred to as Radio Frequency or RF) interfaces.

In some embodiments the processing circuitry may selectively report the status of one or more hydraulic valves via the communication interface. In some embodiments the processing circuitry may selectively control one or more hydraulic valves based upon data transmitted and/or received via the communication interface. In this manner manifolds of the present disclosure may permit the monitoring and/or control of multiple hydraulic valves, and thus multiple hydraulic loads, via shared hydraulic input connections, shared processing circuitry, and/or shared communication interfaces.

In some embodiments, manifolds may incorporate one or more direct or remote mounted sensors to monitor characteristics of the hydraulic fluid. The characteristics so monitored may include pressure, temperature, flow rate, contamination, and other attributes useful to the specific application. In some embodiments such sensors may communicate with processing circuitry and/or communication interfaces.

Figure 10:
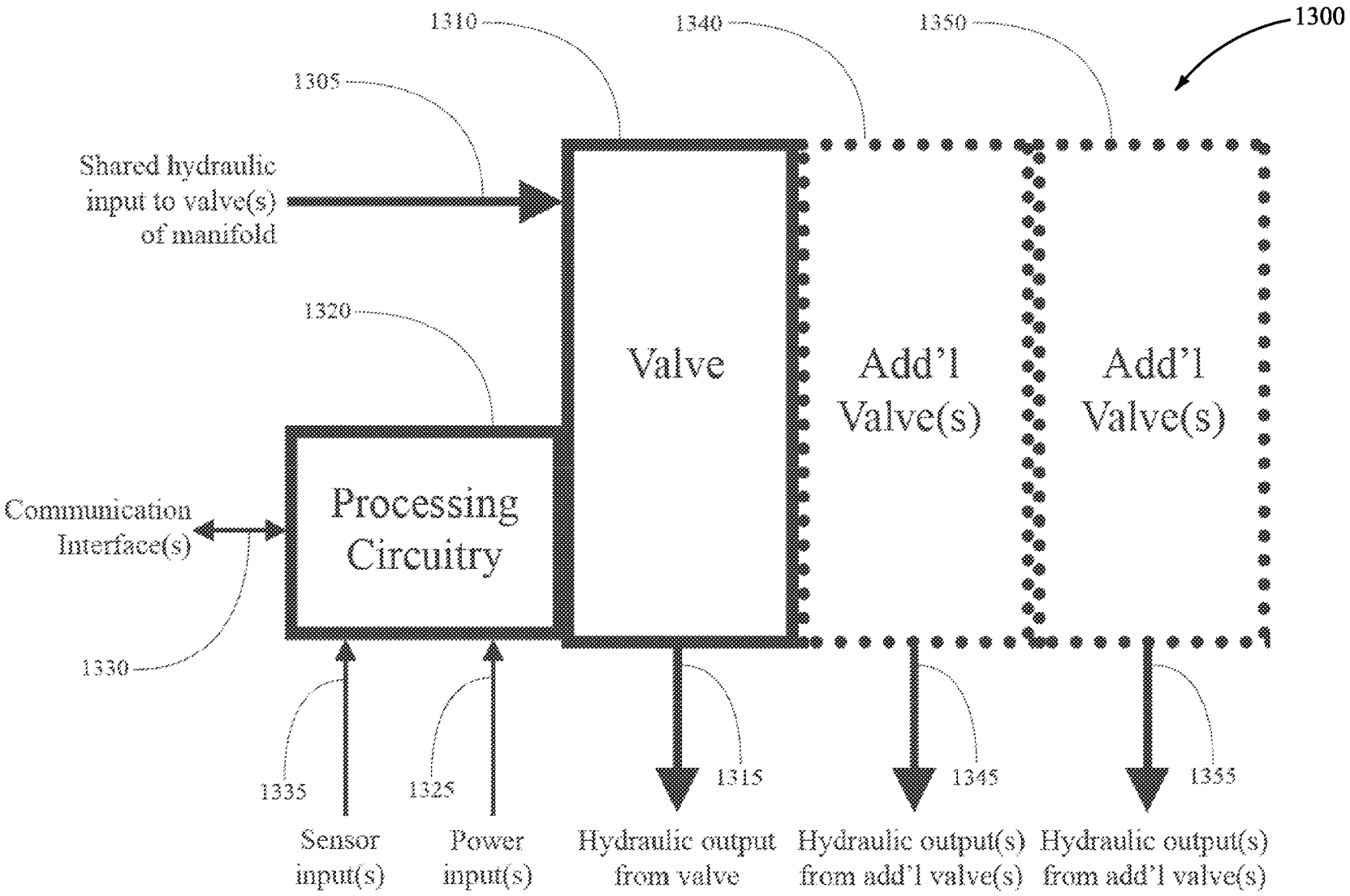
FIG. 10 illustrates one embodiment of a hydraulic fluid manifold assembly according to an embodiment of the present disclosure.

FIG. 10 illustrates one embodiment of a manifold assembly 1300. At least one hydraulic valve 1310 can receive hydraulic fluid from a hydraulic input or source 1305, and selectively delivers hydraulic fluid to output 1315. The hydraulic input can be considered a chamber configured to be a hydraulic fluid source. The chamber can define a portion of a hydraulic tank, a reservoir, or a manifold assembly intake, for example. The chamber can have at least one conduit or output 1315 in selective fluid communication with the chamber using the at least one valve operatively aligned with the at least one conduit. Processing circuitry can be operatively coupled to the at least one valve to facilitate the selective fluid communication. Hydraulic fluid can be distributed aboard a watercraft by controlling the at least one valve to provide hydraulic fluid from the source, such as a hydraulic pump to one or more hydraulic components.

The manifolds can include a plurality of conduits such as outputs 1315, 1345, and/or 1355, one or more of which can be in selective fluid communication with the chamber and individual valves 1310, 1340, and 1350 which can be operatively aligned with each of the plurality of conduits. The selective fluid communication of the conduits with the chamber can be selected and/or controlled by opening or closing one or more of the valves of the plurality of valves. Hence, when a conduit is in fluid communication the valve is open or at least partially open. Alternative implementations of the present disclosure can include separating valves and/or conduits with additional conduits that can be considered part of the chamber or hydraulic fluid source. A hydraulic pump can be considered a hydraulic fluid source and the valves and/or conduits can be connected via one or more of hoses, hard tubing, fittings, and/or direct attachments. The connections can be operatively engaged with one or more of hydraulic fluid filters, hydraulic fluid reservoirs, and/or hydraulic fluid coolers, for example.

Processing circuitry 1320 receives power via power input 1325, and selectively controls power to the valve(s) of the manifold. Processing circuitry 1320 may also monitor the status of the valve(s) of the manifold.

Sensor input(s) 1335 may be used to interact with sensors and/or transducers not shown but that may be mounted directly to, or remotely from, manifold 1300. Example sensor inputs can be in operable communication with the processing circuitry where the measurements from same can be displayed and/or used to dictate valve and/or flow configurations through the manifold assembly to hydraulic components.

Communication interface(s) 1330 may be used to selectively communicate with other devices. For example, data received via communication interface(s) 1330 may instruct processing circuitry 1320 to control valve(s) in the manifold. Data transmitted via communication interface(s) 1330 may report on the status of one or more valve(s) in the manifold or one or more sensor(s) connected via sensor input(s) 1335.

In embodiments of manifold 1300 which incorporate multiple hydraulic valves, additional valve 1340 with its corresponding output 1345 may be present to provide a second selectively controllable output. Likewise, additional valve 1350 with its corresponding output 1355 may be present to provide a third selectively controllable output. Yet further valves may be added to a manifold in this manner as dictated by the specifics of the application. Regardless of the number of valves, processing circuitry 1320 may selectively control some or all valves in the manifold autonomously, in reaction to data on communication interface(s) 1330, in reaction to data on sensor input(s) 1335, or any combination.

The assembly can include the communication interface operatively coupled to the processing circuitry. The communication interface can be operatively configured to engage one or more of Controller Area Network, Local Interconnect Network, NMEA, Ethernet, analog, optical, and/or wireless communications.

The processing circuitry can also be operatively engaged with one or more of the sensors that are configured to measure one or more of pressure, temperature, flow rate, and/or contamination of the hydraulic fluid.

Hydraulic fluid is not limited to generating rotary power via hydraulic motors, and some embodiments of the present disclosure use hydraulic fluid to operate other types of loads. For example, as mentioned above hydraulic cylinders can convert power from hydraulic fluid to linear and/or reciprocal motion. Such motion is suitable for a wide variety of applications such as opening and closing hatch covers, raising and lowering watercraft towers, and positioning trim tabs. In many such applications the amount of power required can be quite high, and the use of hydraulic power instead of traditional electrical power can yield similar advantages to that obtained from hydraulic power in ballast pumping as described earlier herein. The present disclosure may be used with any type of hydraulic load, and the various hydraulic components may be scaled in size and power, as is suitable for the specifics of the application.

Figure 11A:
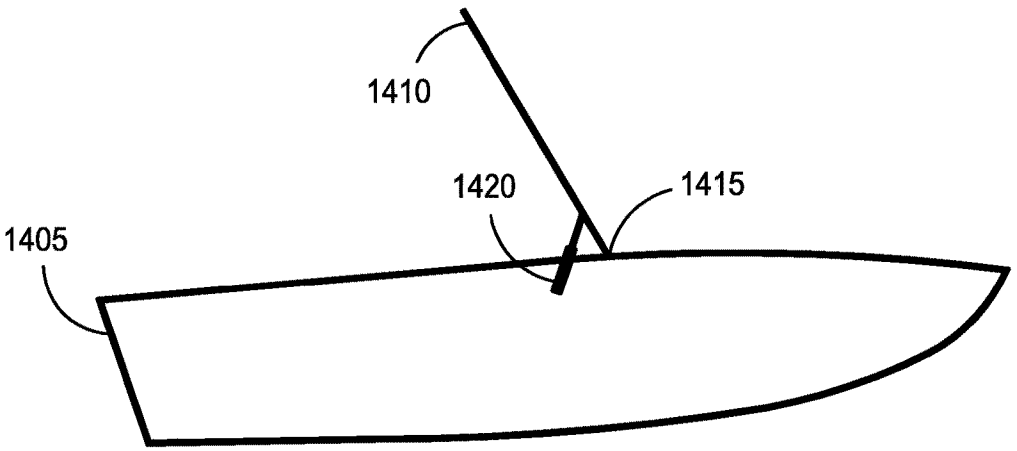
FIGS. 11A and 11B illustrate one embodiment of a hydraulic fluid component configured as a hydraulic cylinder operable to raise or lower a tower on a wakeboat according to the present disclosure.
Figure 11B:
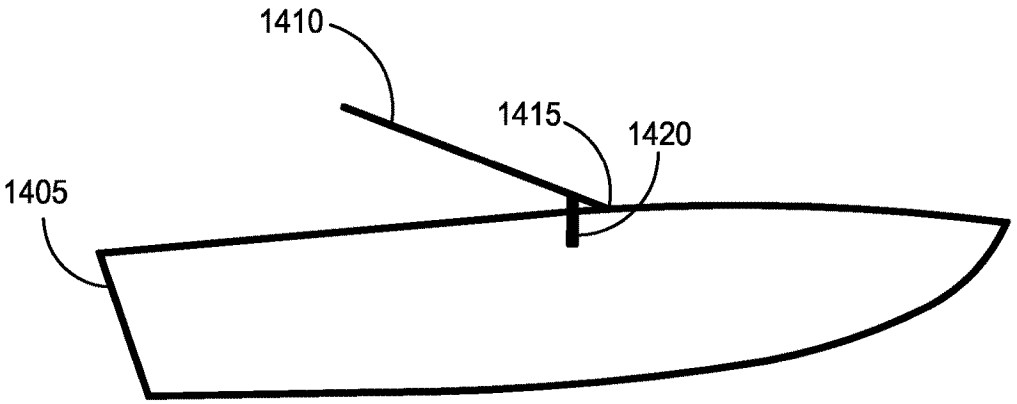

An example embodiment employing a hydraulic cylinder, in this case to raise and lower a watercraft tower, is shown in FIG. 11A and FIG. 11B. FIG. 11A is a simplified illustration of a wakeboat with its tower in a raised ("working") position. Hull 1405 supports tower 1410, which has a pivot point 1415 allowing tower 1410 to rotate to an upright position as positioned by hydraulic cylinder 1420. In some embodiments, the locations of hydraulic cylinder 1420 and pivot point 1415, and the mounting location and maximum height of tower 1410, may be changed for functional, aesthetic, and/or other reasons.

FIG. 11B is a simplified illustration of the watercraft with tower 1410 in a lowered ("storage") position. Hydraulic cylinder 1420 has altered its overall length, causing tower 1410 to rotate around pivot point 1415 and reduce the height of tower 1410 above hull 1405 (and, thus, the overall height of the watercraft). As noted above, the locations and mounting of the various components may be changed based upon various considerations; for example, in some embodiments the position of hydraulic cylinder 1420 may be lowered in the hull, and/or its size changed, to permit tower 1410 to be positioned to an even lower "storage" position to facilitate passage under low bridges, storage in buildings with short access doors, reduced drag during transport on a trailer, and other advantages. The design of tower 1410, its pivot point 1415, and other characteristics may also be modified to optimize for the specifics of the application in some embodiments, for example employing articulated joints in tower 1410 to "fold" tower 1410 as it descends to the "storage" position.

In some embodiments the hydraulic cylinder(s) of the present disclosure may be positioned anywhere in their overall range of travel, to obtain intermediate positioning of the associated movable components. To continue with the watercraft tower example above, hydraulic cylinder 1420 need not be used solely in its fully retracted or fully extended positions. Selectively, hydraulic cylinder 1420 may be positioned at an intermediate length to position tower 1410 at a "middle" height perhaps preferred by some passengers aboard the watercraft.

Another hydraulic component to be operatively coupled with the hydraulic fluid can be a hydraulic motor, such as the motor that drives a ballast pump. Other embodiments may use such hydraulic motors to power bilge pumps, winches, and similar loads where rotational motion is preferable to linear motion.

It is important to emphasize the differences between electric and hydraulic motors, as this highlights one of the many advantages of the present disclosure. A typical 2 HP electric motor is over a foot long, over half a foot in diameter, and weighs nearly 50 pounds. In stark contrast, a typical 2 HP hydraulic motor such as the Parker Gresen MGG20010 (Parker Hannifin Corporation, 1775 Logan Avenue, Youngstown Ohio 44501, United States) is less than four inches long, less than four inches in diameter, and weighs less than three pounds.

Stated another way: A 2 HP electric motor is large, awkward, heavy, and cumbersome. But a 2 HP hydraulic motor can literally be held in the palm of one hand.

The weight and volumetric savings of hydraulic motors is multiplied by the number of motors required in the ballast system. In a typical system with a fill and a drain pump on two large ballast compartments, four 2 HP electric motors would consume over 1700 cubic inches and weigh approximately 200 pounds. Meanwhile, four of the above 2 HP hydraulic motors would consume just 256 cubic inches (a 85% savings) and weigh under 12 pounds (a 94% savings). By delivering dramatic savings in both volume and weight, hydraulic embodiments of the present disclosure give watercraft designers vastly more flexibility in their design decisions.

With hydraulic power converted to mechanical power, hydraulic embodiments of the present disclosure must next use that mechanical power to drive the ballast pumps that actually move the ballast water.

The watercraft industry has experimented with many different types of ballast pumps in its pursuit of better ballast systems. The two most prominent types are referred to as "impeller" pumps and "aerator" pumps.

"Impeller pumps", also known as "flexible vane impeller pumps", can include a rotating impeller with flexible vanes that form a seal against an enclosing volute. The advantages of such pumps include the potential to self-prime even when above the waterline, tolerance of entrained air, ability to operate bidirectionally, and inherent protection against unintentional through-flow. Their disadvantages include higher power consumption for volume pumped, noisier operation, wear and periodic replacement of the flexible impeller, and the need to be disassembled and drained to avoid damage in freezing temperatures.

One such impeller pump body product line is the Johnson F35B, F4B, FSB, F7B, F8B, and related series (Johnson Pump/SPX Flow, 5885 11th Street, Rockford Ill. 61109 United States). Using the F8B as an example, the pump body can be driven by the shaft of a small hydraulic motor such as that as described above. The resulting pump assembly then presents a 1.5 inch water inlet and a 1.5 inch water outlet through which water will be moved when power is conveyed from the engine, through the hydraulic pump, thence to the hydraulic motor, and finally to the water pump.

"Aerator pumps", also known as "centrifugal pumps", can include a rotating impeller that maintains close clearance to, but does not achieve a seal with, an enclosing volute. The advantages of such pumps include higher flow volume for power consumed, quieter operation, no regular maintenance during the life of the pump, and a reduced need for freezing temperature protection. Their disadvantages include difficulty or inability to self-prime, difficulty with entrained air, unidirectional operation, and susceptibility to unintentional through-flow.

Hydraulic embodiments of the present disclosure are compatible with both impeller and aerator pumps. Indeed, they are compatible with any type of pump for which hydraulic power can be converted to the mechanical motion required. This can include but is not limited to piston-like reciprocal motion and linear motion. In most watercraft applications, this will be rotational motion which can be provided by a hydraulic motor mechanically coupled to a pump "body" comprising the water-handling components.

As noted earlier, existing ballast pumps used by the wakeboat industry have flow volumes well below the example 100 GPM goal expressed earlier. Indeed, there are few flexible vane impeller style pumps for any industry that can deliver such volumes. When the required volume reaches these levels, centrifugal pumps become the practical and space efficient choice and this discussion will focus on centrifugal pumps. However, this in no way limits the application of the present disclosure to other types of pumps; ultimately, moving large amounts of water is a power conveyance challenge and the present disclosure can answer that challenge for any type of pump.

The low-volume centrifugal (or aerator) pumps traditionally used by the wakeboat industry have integrated electric motors for convenience and ignition proofing. Fortunately, the pump manufacturing industry offers standalone (i.e. motorless) centrifugal pump "bodies" in sizes capable of satisfying the goals of the present disclosure.

One such centrifugal pump product line includes the 150 PO at ~50 GPM, the 200 PO at ~100 GPM, and 300 PO at ~240 GPM (Banjo Corporation, 150 Banjo Drive, Crawfordsville Ind. 47933, United States). Using the 200 PO as an example, the pump body can be driven by the shaft of a small hydraulic motor such as that as described above. The resulting pump assembly then presents a two inch water inlet and a two inch water outlet through which water will be moved when power is conveyed from the engine, through the hydraulic pump, thence to the hydraulic motor, and finally to the water pump.

Figure 7:
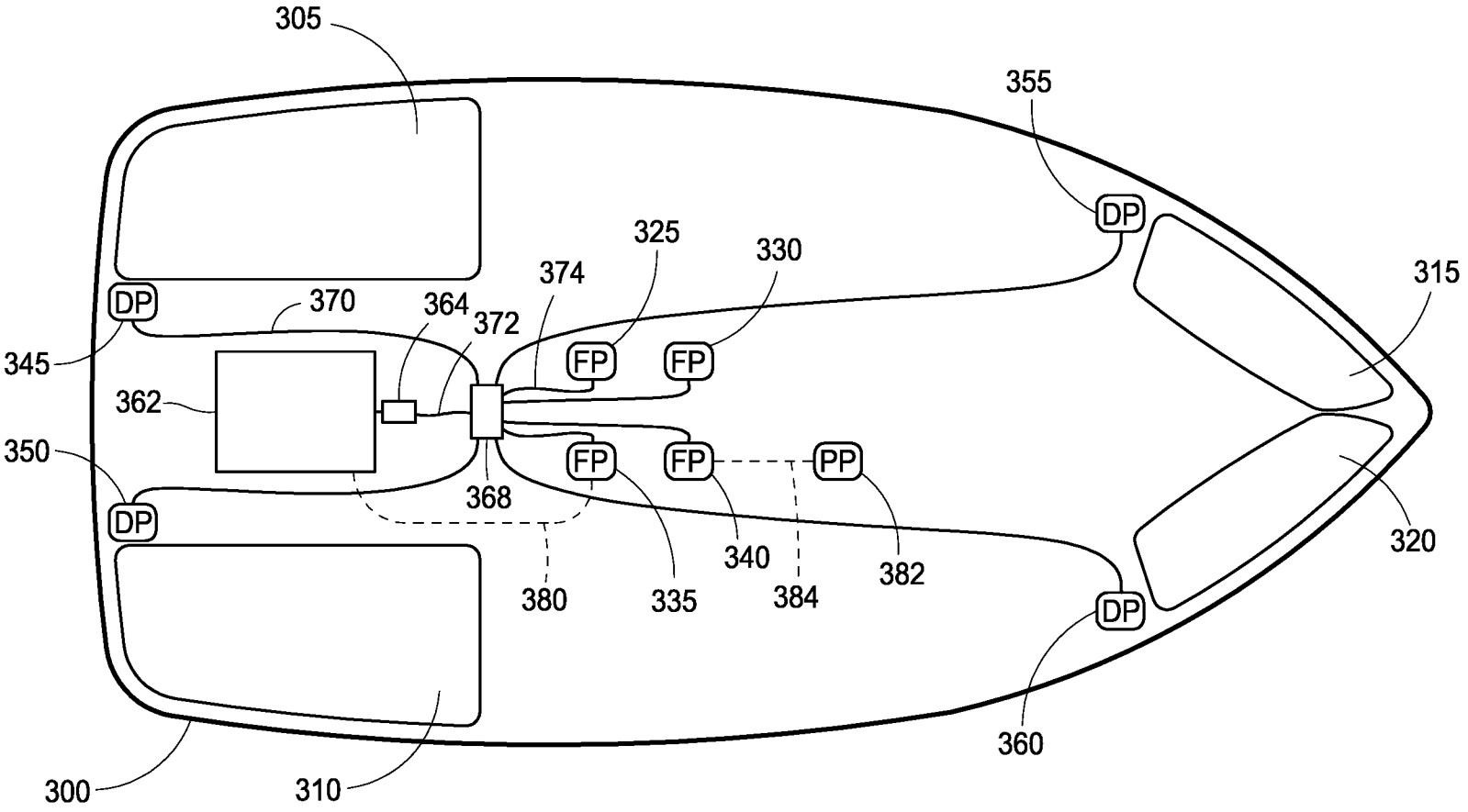
FIG. 7 illustrates one embodiment of the present disclosure using an engine powered hydraulic pump with unidirectional fill and drain ballast pumps.

For a ballast system using centrifugal pumps, generally two such pumps will be required per ballast compartment: A first for filling the compartment, and a second for draining it. FIG. 7 portrays one embodiment of the present disclosure using an engine mounted, direct drive hydraulic pump with remotely mounted hydraulic motors and separate fill and drain ballast pumps. The example locations of the ballast compartments, the fill pumps, and the drain pumps in FIG. 7 match those of other figures herein for ease of comparison and reference, but water plumbing has been omitted for clarity.

In FIG. 7, watercraft 300 includes an engine 362 that, in addition to providing power for traditional purposes, powers hydraulic pump 364. Hydraulic pump 364 selectively converts the rotational energy of engine 362 to pressurized hydraulic fluid.

Hydraulic lines 370, 372, 374, and others in FIG. 7 can include supply and return lines for hydraulic fluid between components of the system. Hydraulic lines in this and other figures in this disclosure may include stiff metal tubing (aka "hardline"), flexible hose of various materials, or other material(s) suitable for the specific application. For convenience, many watercraft installations employing the present disclosure will use flexible hose and thus the figures illustrate their examples as being flexible.

Continuing with FIG. 7, hydraulic lines 372 convey hydraulic fluid between hydraulic pump 364 and hydraulic manifold 368. Hydraulic manifold 368 can be an assembly of hydraulic valves and related components that allow selective routing of hydraulic fluid between hydraulic pump 364 and the hydraulic motors powering the ballast pumps.

Hydraulic-powered filling and draining of ballast compartment 305 will be referenced by way of example for further discussion. Similar operations would, of course, be available for any other ballast compartments in the system.

Remaining with FIG. 7, when it is desired to fill ballast compartment 305, the appropriate valve(s) in hydraulic manifold 368 are opened. Pressurized hydraulic fluid thus flows from hydraulic pump 364, through the supply line that is part of hydraulic line 372, through the open hydraulic valve(s) and/or passages(s) that is part of hydraulic manifold 368, through the supply line that is part of hydraulic line 374, and finally to the hydraulic motor powering fill pump 325 (whose ballast water plumbing has been omitted for clarity).

In this manner, mechanical engine power is conveyed to fill pump 325 with no intervening, wasteful, and expensive conversion to or from electric power.

Exhaust hydraulic fluid from the hydraulic motor of fill pump 325 flows through the return line that is part of hydraulic line 374, continues through the open hydraulic valve(s) and/or passage(s) that are part of hydraulic manifold 368, through the return line that is part of hydraulic line 372, and finally back to hydraulic pump 364 for repressurization and reuse. In this manner, a complete hydraulic circuit is formed whereby hydraulic fluid makes a full "round trip" from the hydraulic pump, through the various components, to the load, and back again to the hydraulic pump.

As noted elsewhere herein, some common components of a hydraulic system, including but not limited to filters and reservoirs and oil coolers, have been omitted for the sake of clarity. It is to be understood that such components would be included as desired in a functioning system.

Draining operates in a similar manner as filling. As illustrated in FIG. 7, the appropriate valve(s) in hydraulic manifold 368 are opened. Pressurized hydraulic fluid is thus provided from hydraulic pump 364, through the supply line that is part of hydraulic line 372, through the open hydraulic valve(s) and/or passages(s) that are part of hydraulic manifold 368, through the supply line that is part of hydraulic line 370, and finally to the hydraulic motor powering drain pump 345 (whose ballast water plumbing has been omitted for clarity).

In this manner, mechanical engine power is conveyed to drain pump 345 with no intervening, wasteful, and expensive conversion to or from electric power.

Exhaust hydraulic fluid from the hydraulic motor of drain pump 345 flows through the return line that is part of hydraulic line 370, continues through the open hydraulic valve(s) and/or passage(s) that are part of hydraulic manifold 368, thence through the return line that is part of hydraulic line 372, and finally back to hydraulic pump 364 for repressurization and reuse. Once again, a complete hydraulic circuit is formed whereby hydraulic fluid makes a full "round trip" from the hydraulic pump, through the various components, to the load, and back again to the hydraulic pump. Engine power thus directly drives the drain pump to remove ballast water from the ballast compartment.

For a typical dual centrifugal pump implementation, the first pump (which fills the compartment) has its inlet fluidly connected to a throughhull fitting that permits access to the body of water surrounding the hull of the watercraft. Its outlet is fluidly connected to the ballast compartment to be filled. The ballast compartment typically has a vent near its top to allow air to 1) escape from the compartment during filling, 2) allow air to return to the compartment during draining, and 3) allow excessive water to escape from the compartment in the event of overfilling.

In some embodiments, this fill pump's outlet connection is near the bottom of the ballast compartment. In these cases, a check valve or other unidirectional flow device may be employed to prevent unintentional backflow through the pump body to the surrounding water.

In other embodiments, the fill pump's outlet connection is near the top of the ballast compartment, often above the aforementioned vent such that the water level within the compartment will drain through the vent before reaching the level pump outlet connection. This configuration can prevent the establishment of a syphon back through the fill pump body while eliminating the need for a unidirectional flow device, saving both the cost of the device and the flow restriction that generally accompanies them.

Centrifugal pumps often require "priming", i.e. a certain amount of water in their volute, to establish a flow of water when power is first applied. For this reason, some embodiments of the present disclosure locate the fill pump's inlet below the waterline of the hull. Since "water finds its own level", having the inlet below the waterline causes the fill pump's volute to naturally fill from the surrounding water.

However, certain throughhull fittings and hull contours can cause a venturi effect which tends to vacuum, or evacuate, the water backwards out of a fill pump's throughhull and volute when the hull is moving. If this happens, the fill pump may not be able to self-prime and normal ballast fill operation may be impaired. Loss of pump prime is a persistent problem faced by the watercraft industry and is not specific to the present disclosure.

To solve the priming problem, some embodiments of the present disclosure selectively route a portion of the engine cooling water to an opening in the pump body, thus keeping the pump body primed whenever the engine is running. In accordance with example implementations, one or more pumps can be operatively associated with the engine via water lines. FIG. 7 depicts one such water line 380 conveying water from engine 362 to ballast pump 335 (for clarity, only a single water line to a single ballast pump is shown). If a venturi or other effect causes loss of water from the pump body, the engine cooling water will constantly refill the pump body until its fill level reaches its inlet, at which point the excess will exit to the surrounding body of water via the inlet throughhull. If no loss of water from the pump body occurs, the engine cooling water will still exit via the inlet throughhull.

This priming technique elegantly solves the ballast pump priming problem whether a priming problem actually exists or not, under varying conditions, with no user intervention or even awareness required. The amount of water required is small, so either fresh (cool) or used (warm) water from the engine cooling system may be tapped depending upon the specifics of the application and the recommendation of the engine manufacturer. Water used for priming in this manner drains back to the surrounding body of water just as it does when it otherwise passes through the engine's exhaust system.

Other embodiments obtain this pump priming water from alternative sources, such as a small electric water pump. This is useful when engine cooling water is unavailable or inappropriate for pump priming, such as when the engine has a "closed" cooling system that does not circulate fresh water from outside. The source of priming water may be from the water surrounding the hull, one or more of the ballast compartments, a freshwater tank aboard the vessel, a heat exchanger for the engine or other component, or another available source specific to the application. FIG. 7 depicts such a water pump 382, providing priming water via water line 384 to pump 340 (for clarity, only a single water line to a single ballast pump is shown).

In certain embodiments, a check valve or other unidirectional flow device is installed between the source of the priming water and the opening in the pump body. For example, engine cooling system pressures often vary with RPM and this valve can prevent backflow from the ballast water to the engine cooling water.

Some embodiments incorporate the ability to selectively enable and disable this flow of priming water to the ballast pump. This can be useful if, for example, the arrangement of ballast compartments, hoses, and other components is such that the pressurized priming water might unintentionally flow into a ballast compartment, thus changing its fill level. In such cases the priming function can be selectively enabled and disabled as needed. This selective operation may be accomplished in a variety of ways, such as electrically (powering and/or depowering a dedicated electric water pump), mechanically (actuating a valve), or other means as suited to the specifics of the application.

The second pump in the dual centrifugal pump example (which drains the compartment) has its inlet fluidly connected to the ballast compartment to be drained. Its outlet is fluidly connected to a throughhull fitting that permits disposal of drained ballast water to the outside of the hull of the watercraft.

Some embodiments of the present disclosure locate this drain pump's inlet connection near the bottom of the ballast compartment. The pump body is generally oriented such that it is kept at least partially filled by the water to be potentially drained from the compartment, thus keeping the pump body primed. In some embodiments where such a physical arrangement is inconvenient, the fill pump priming technique described above may be optionally employed with the drain pump.

The present disclosure is not limited to using two centrifugal pumps per ballast compartment. As noted earlier, other pump styles exist and the present disclosure is completely compatible with them. For example, some embodiments of the present disclosure may use a single reversible impeller pump body to both fill and drain a ballast compartment instead of two separate centrifugal pumps for fill and drain. Most hydraulic motors can be driven bidirectionally, so powering a reversible pump body in either the fill or drain direction is supported by the present disclosure if suitable hydraulic motors are employed.

Figure 8:
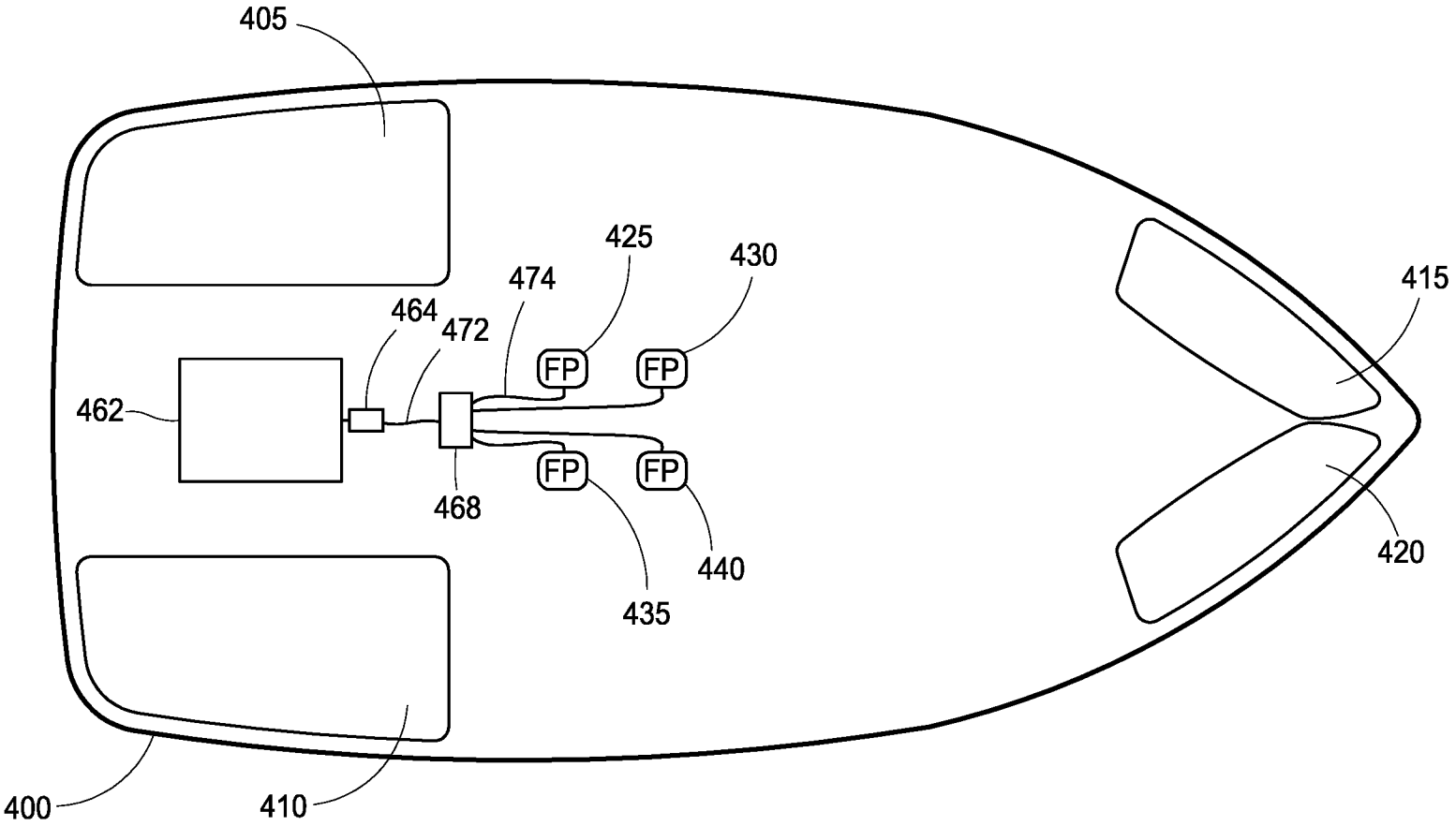
FIG. 8 illustrates one embodiment of the present disclosure using an engine powered hydraulic pump powering reversible ballast pumps.

FIG. 8 portrays one embodiment of the present disclosure using an engine mounted, direct drive hydraulic pump with remotely mounted hydraulic motors and a single reversible fill/drain ballast pump per compartment. The example locations of the ballast compartments, the fill pumps, and the drain pumps in FIG. 8 match those of other figures herein for ease of comparison and reference, but water plumbing has been omitted for clarity.

In FIG. 8, watercraft 400 includes an engine 462 that, in addition to providing power for traditional purposes, powers hydraulic pump 464. Hydraulic pump 464 selectively converts the rotational energy of engine 462 to pressurized hydraulic fluid.

Hydraulic lines 472, 474, and others in FIG. 8 can include supply and return lines for hydraulic fluid between components of the system. Hydraulic lines 472 convey hydraulic fluid between hydraulic pump 464 and hydraulic manifold 468. Hydraulic manifold 468, as introduced earlier, is an assembly of hydraulic valves and related components that allow selective routing of hydraulic fluid between hydraulic pump 464 and the hydraulic motors powering the ballast pumps. Unlike hydraulic manifold 368 of FIG. 7, however, hydraulic manifold 468 of FIG. 8 can include bidirectional valves that selectively allow hydraulic fluid to flow in either direction.

Hydraulic-powered filling and draining of ballast compartment 405 will be used for further discussion. Similar operations would, of course, be available for any other ballast compartments in the system.

Remaining with FIG. 8: When it is desired to fill ballast compartment 405, the appropriate valve(s) in hydraulic manifold 468 are opened. Pressurized hydraulic fluid is thus flow in the "fill" direction from hydraulic pump 464, through the supply line that is part of hydraulic line 472, through the open hydraulic valve(s) and/or passages(s) that is part of hydraulic manifold 468, through the supply line that is part of hydraulic line 474, and finally to the hydraulic motor powering reversible pump (RP) 425, whose ballast water plumbing has been omitted for clarity.

Since hydraulic manifold 468 is providing flow to reversible pump 425 in the fill direction, reversible pump 425 draws water from the surrounding body of water and moves it to ballast compartment 405. In this manner, mechanical engine power is conveyed to the hydraulic motor powering reversible pump 425 with no intervening, wasteful conversion to or from electric power.

Exhaust hydraulic fluid from the hydraulic motor powering reversible pump 425 flows through the return line that is part of hydraulic line 474, continues through the open hydraulic valve(s) and/or passage(s) that are part of hydraulic manifold 468, through the return line that is part of hydraulic line 472, and finally back to hydraulic pump 464 for repressurization and reuse.

During draining with a single reversible ballast pump per compartment, the same hydraulic line 474 is used but the flow directions are reversed. Continuing with FIG. 8, the appropriate valve(s) in hydraulic manifold 468 are opened. Pressurized hydraulic fluid thus flows from hydraulic manifold 468—but in this case, in the opposite direction from that used to power reversible pump 425 in the fill direction.

Thus the roles of the supply and return lines that are part of hydraulic line 474 are reversed from those during filling. When draining, the hydraulic fluid from hydraulic manifold 468 flows toward the hydraulic motor powering reversible pump 425 via what was, during filling, the return line that is part of hydraulic line 474. Likewise, exhaust hydraulic fluid from the hydraulic motor powering reversible pump 425 flows through the return line that is part of hydraulic line 474, continues through the open hydraulic valve(s) and/or passage(s) that are part of hydraulic manifold 468, thence through the return line that is part of hydraulic line 472, and finally back to hydraulic pump 464 for repressurization and reuse.

Once again, a complete hydraulic circuit is formed whereby hydraulic fluid makes a full "round trip" from the hydraulic pump, through the various components, to the load, and back again to the hydraulic pump. When employing reversible ballast pumps, however, the direction of hydraulic fluid flow in supply and return lines that are part of hydraulic line 474 reverses depending upon which direction the ballast pump is intended to move water.

Some embodiments of the present disclosure use one or more ballast pumps to move water between different ballast compartments. Adding one or more "cross pumps" in this manner can dramatically speed adjustment of ballast.

Figure 9:
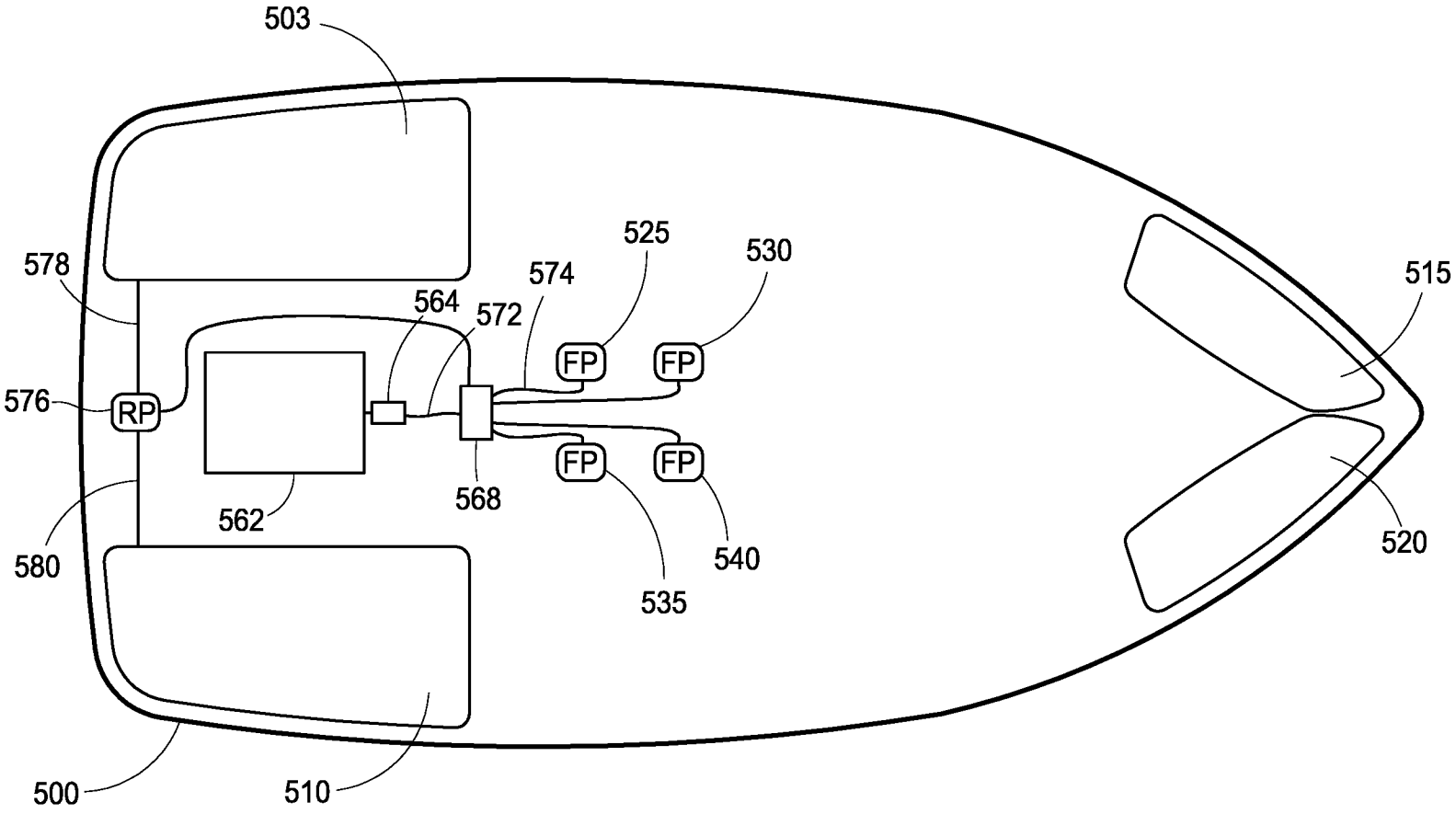
FIG. 9 illustrates one embodiment of the present disclosure using an engine powered hydraulic pump powering a reversible ballast cross pump between two ballast compartments.

FIG. 9 illustrates one embodiment. Once again, engine 562 provides power to hydraulic pump 564, which provides pressurized hydraulic fluid to hydraulic manifold 568. Ballast pump 576, a reversible ballast pump powered by a hydraulic motor, has one of its water ports fluidly connected to ballast compartment 505. The other of its water ports is fluidly connected to ballast compartment 510. Rotation of pump 576 in one direction will move water from ballast compartment 805 to ballast compartment 510; rotation of pump 576 in the other direction will move water in the other direction, from ballast compartment 510 to ballast compartment 505.

Operation closely parallels that of the other reversible pumps in previous examples. When hydraulic manifold 568 allows hydraulic fluid to flow through hydraulic line 582 to the hydraulic motor powering ballast pump 576, pump 576 will move water in the associated direction between the two ballast compartments. When hydraulic manifold 568 can be configured to direct hydraulic fluid to flow through hydraulic line 582 in the opposite direction, the hydraulic motor powering pump 576 will rotate in the opposite direction and pump 576 will move water in the opposite direction.

Other embodiments of the present disclosure accomplish the same cross pumping by using two unidirectional pumps, each with its inlet connected to the same ballast compartment as the other pump's outlet. By selective powering of the hydraulic motor powering the desired ballast pump, water is transferred between the ballast compartments.

Some embodiments of the present disclosure include a traditional electric ballast pump as a secondary drain pump for a ballast compartment. This can provide an electrical backup to drain the compartment should engine power be unavailable. The small size of such pumps can also permit them to be mounted advantageously to drain the final portion of water from the compartment, affording the watercraft designer more flexibility in arranging the components of the overall system.

Some embodiments of the present disclosure include the ability to detect fluid in the ballast plumbing. This can act as a safety mechanism, to ensure that ballast draining operations are proceeding as intended. It can also help synchronize on-board systems with actual ballast filling and draining, since there can be some delay between the coupling of power to a ballast pump and the start of actual fluid flow. The flow sensor can be, for example, a traditional inline impeller-style flow sensor; this type of sensor may also yield an indication of volume.

Some embodiments of the present disclosure use one or more ballast pumps to act as side (or lateral) thrusters. Much like high volume ballast pumps, side thrusters can consume large amounts of power to move water. Traditional side thrusters typically require extremely high electrical current flows reminiscent of those associated with the electrical ballast pumps discussed above, for the same reasons, and with the same associated problems. Traditional side thrusters are also often mounted externally on the hull (typically at or near the transom) where they are exposed to damage and represent an injury hazard to those in the water, or mounted in a tube through the hull which may detract from the latter's hydrodynamic performance, structural integrity, and/or manufacturing cost efficiencies.

Despite the problems and challenges associated with extreme electrical requirements, some thrusters nevertheless employ multi-horsepower electric motors to drive large water pumps. For example, US Marine Products (141 Seaview Avenue, Bass River Mass. 02664 United States) offers a series of thrusters of which their JT30 is the smallest and most "compact". Despite its "small" size, the JT30 requires 480 amperes of current at 12 VDC, or nearly 6000 watts of electric power. As noted elsewhere herein, such power levels are far beyond those found on traditional watercrafts. Such watercraft also generally lack the very expensive cabling and switching components required to manage such currents even if they were available.

Ultimately, the goal of a side thruster is to move water laterally relative to the hull to apply a sideways force to the hull. Some embodiments of the present disclosure accomplish this goal by using a hydraulically powered ballast (water) pump to propel a jet or stream of water to one side or the other of the hull. In some embodiments, this sideways force may be used to rotate the hull in the water. In some embodiments, this sideways force may be used to "shift" the hull laterally in the water.

Figure 12A:
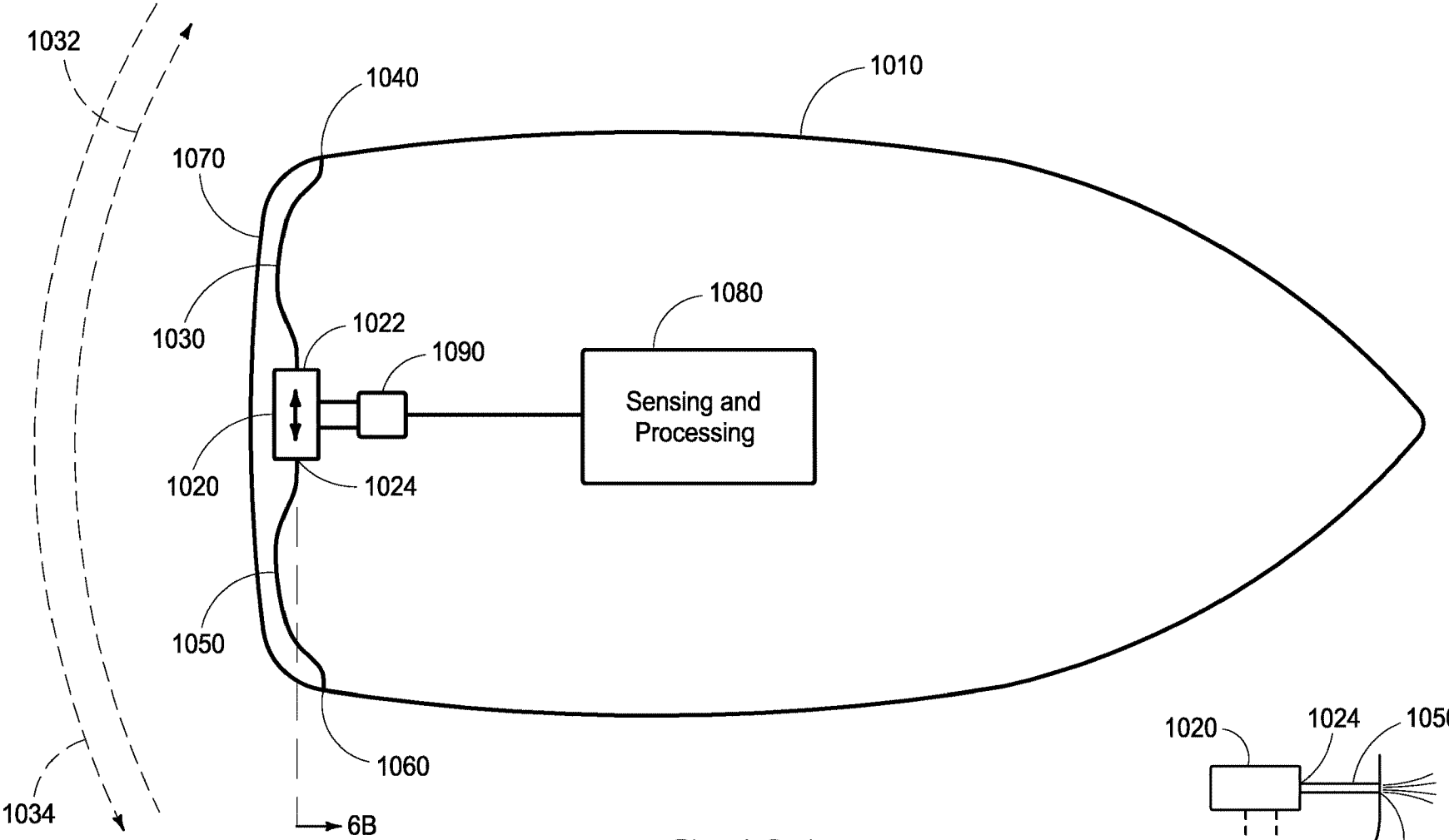
FIGS. 12A and 12B illustrate a boat propulsion assembly in accordance with an embodiment of the disclosure.

FIGS. 10A and 10B illustrate at least one boat propulsion assembly in accordance with one embodiment. Hydraulically powered water pump 1020 (hereinafter referred to as thruster pump 1020) can be mounted within boat hull 1010. The pump can be reversible as depicted in FIG. 12A; in other implementations, the pump can be unidirectional. One port 1022 of thruster pump 1010 can be operably connected to conduit 1030. The other end of conduit 1030 is connected to throughhull fitting 1040 on one side of hull 1010 (in FIG. 12A, the left/port side) near transom 1070, for example. The other port 1024 of thruster pump 1020 can be connected to conduit 1050, whose other end can be connected to throughhull fitting 1060 on the other side of hull 1010 (in FIG. 12A, the right/starboard side) near transom 1070. Accordingly, a water pump (including a hydraulically powered water pump) can be operatively coupled to a first conduit in fluid communication with one portion of the hull of the boat. In accordance with other implementations, the other conduit can be coupled to a water source, either in or outside the hull.

Figure 12B:
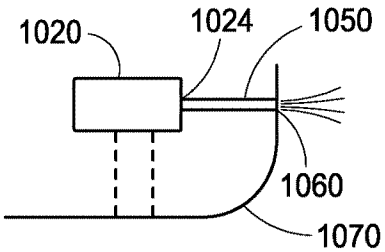

As shown in more detail, the water source for the pump can be the water floating the boat as shown in FIG. 12B, as well as other sources, such as, for example, a ballast container within the hull of the boat or engine/exhaust cooling water. In accordance with example implementations, throughhull fittings can be aligned below the lowest draft water line of the hull of the boat to ensure that the fitting is in fluid communication with the surrounding water when floating.

Various embodiments use flexible hose, rigid hose, tubing, pipe, or other materials, alone or in combinations, for conduits 1030 and 1050. Any suitable conduit may be used as suits the specifics of the application.

With the conduits and throughhulls as described, thruster pump 1020 has the ability to draw water from one side of the hull and express it to the other. The lateral force of the expressed water, occurring near transom 1070 and thus distant from the center of mass of hull 1010, causes hull 1010 to rotate in the direction opposite that of the expelled water, thus propelling the boat. In accordance with other implementations, water can be drawn from the same side of the boat, from below the hull of the boat, or from within the boat and expressed to propel the boat.

For example, if thruster pump 1020 is powered to draw water from throughhull 1040, through conduit 1030, through conduit 1050, and thus express the water out of throughhull 1060, the resulting lateral force will move transom 1070 to the left (toward the left/port side of hull 1010) and hull 1010 will rotate counterclockwise as represented by arrow 1034 in FIG. 12A.

Conversely, if thruster pump 1020 is powered to draw water from throughhull 1060, through conduit 1050, through conduit 1030, and thus express the water out of throughhull 1040, the resulting lateral force will move transom 1070 to the right (toward the right/starboard side of hull 1010) and hull 1010 will rotate clockwise as represented by arrow 1032 in FIG. 12A.

In some embodiments thruster pump 1020 is mounted within hull 1010 as illustrated by FIG. 12A. This protects both thruster pump 1020, and swimmers who may be in the water surrounding the boat, as compared to some traditional side thrusters which are mounted external to hull 1010. In some embodiments, it may still be desirable to mount thruster pump 1020 external to hull 1010, or in a location distant from throughhulls 1040 and 1060 with longer conduits, and the present disclosure supports such configurations.

In some embodiments throughhulls 1040 and 1060 may be located toward the front/bow of hull 1020 when such configurations are suitable for the specifics of the application. In some embodiments multiple thrusters of the present disclosure may be installed in multiple locations of hull 1010 for increased thrust, redundancy, accommodation of varying waterlines due to ballasting, and/or other factors.

Figure 13:
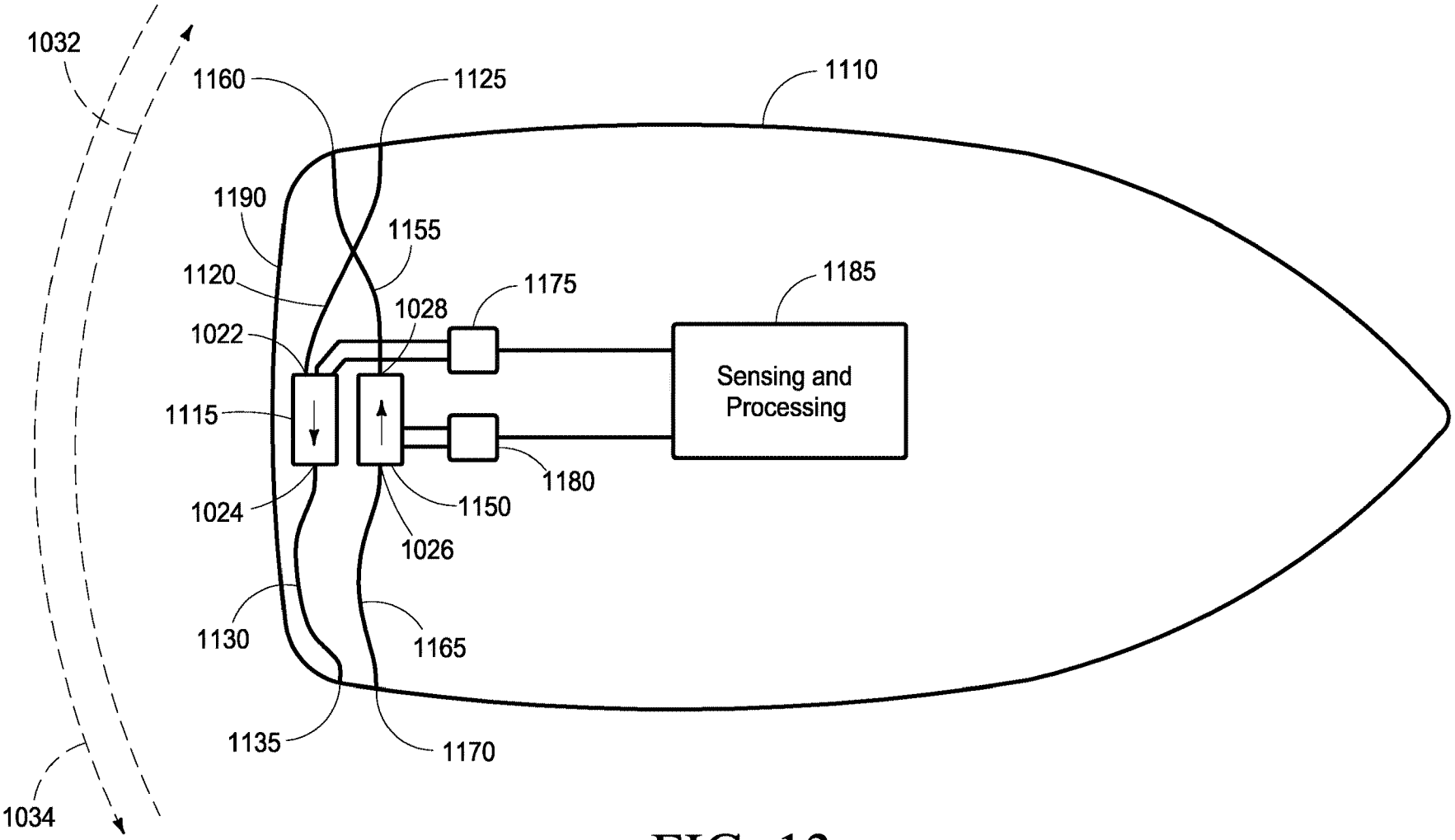
FIG. 13 illustrates a boat propulsion assembly in accordance with another embodiment of the disclosure.

FIG. 13 illustrates another boat propulsion assembly according to an embodiment of the disclosure that can include at least a pair of unidirectional pumps. Pump 1115

(such as a hydraulically powered water pump) can be mounted within hull 1110. Intake port 1022 of pump 1115 can be connected to throughhull fitting 1125 by conduit 1020. Output port 1024 of pump 1115 can be connected to throughhull 1135 by conduit 1030. Thus, pump 1115 may draw water from the left/port side of hull 1110 and express it on the right/starboard side of hull 1110, imparting a clockwise rotation 1032 to hull 1115 from the overhead perspective FIG. 13.

Continuing with FIG. 13, pump 1150 can be mounted within hull 1110. Intake port 1026 of pump 1150 can be connected to throughhull 1170 by conduit 1165. Output port 1028 of pump 1150 can be connected to throughhull 1160 by conduit 1155. Thus pump 1150 may draw water from the right/starboard side of hull 1110 and express it on the left/port side of hull 1110, imparting a counterclockwise rotation 1034 to hull 1115 as viewed from the overhead perspective FIG. 13.

While FIG. 13 shows the thruster pumps drawing water from the side of the hull, the present disclosure does not require such a configuration. Indeed, some embodiments may locate their intakes in other, locations including on the bottom of hull 1110 or on transom 1190 as best suits the specifics of the application. Internal sources of water, such as ballast compartments or engine cooling/exhaust water, may also be used. The present disclosure may accommodate any suitable source of water.

An advantage of some embodiments of the present disclosure is the ability to apply lateral thrust to a hull without attaching the thruster to the exterior of the hull nor requiring a tube through the hull. Instead, the intake and output ports of some embodiments can be similar to traditional "throughhulls" in the marine industry, which are typically installed using simple round openings molded or cut into the hull. Such throughhull techniques have evolved over the decades to minimize deleterious effects on hydrodynamic performance and structural integrity, while easing manufacturing and waterproofing concerns. Such advantages cannot be asserted by thrusters which are mounted externally or within large tube-like penetrations through the hull.

Another advantage of some embodiments is increased design and manufacturing flexibility for watercraft Engineers. Embodiments which employ throughhull techniques and flexible fluid conduits of the present disclosure are less constrained with respect to the location and mounting of thruster components such as motors and pumps. While externally mounted thrusters must (by definition) mount to the outside of the hull, and while tube-enclosed thrusters require a solid, straight-through tubular penetration of the hull in the desired location of the thruster, some embodiments of the present disclosure afford watercraft Engineers the flexibility to locate the thruster ports for best performance without necessarily dictating the specific locations of other components of the thruster system.

Some embodiments integrate the side thrusters with other subsystems. For example, the intake and exhaust throughhulls of a ballast system may be arranged in the hull such that the ballast pumps can also serve as thruster pumps via selective operation. Referring to FIG. 13 again, if exhaust throughhulls 1135 and 1160 are selectively operated simultaneously, a net zero lateral force may be realized and hull 1110 may experience no net rotational force. Conversely, if one or the other of exhaust throughhulls 1135 and 1160 are operated alone, or more powerfully than the other, a net nonzero lateral force may result and hull 1110 may thus be rotated in either direction.

Other subsystems, such as the steering apparatus of the watercraft, may also benefit from integration with the thruster of the present disclosure.

Figure 14:
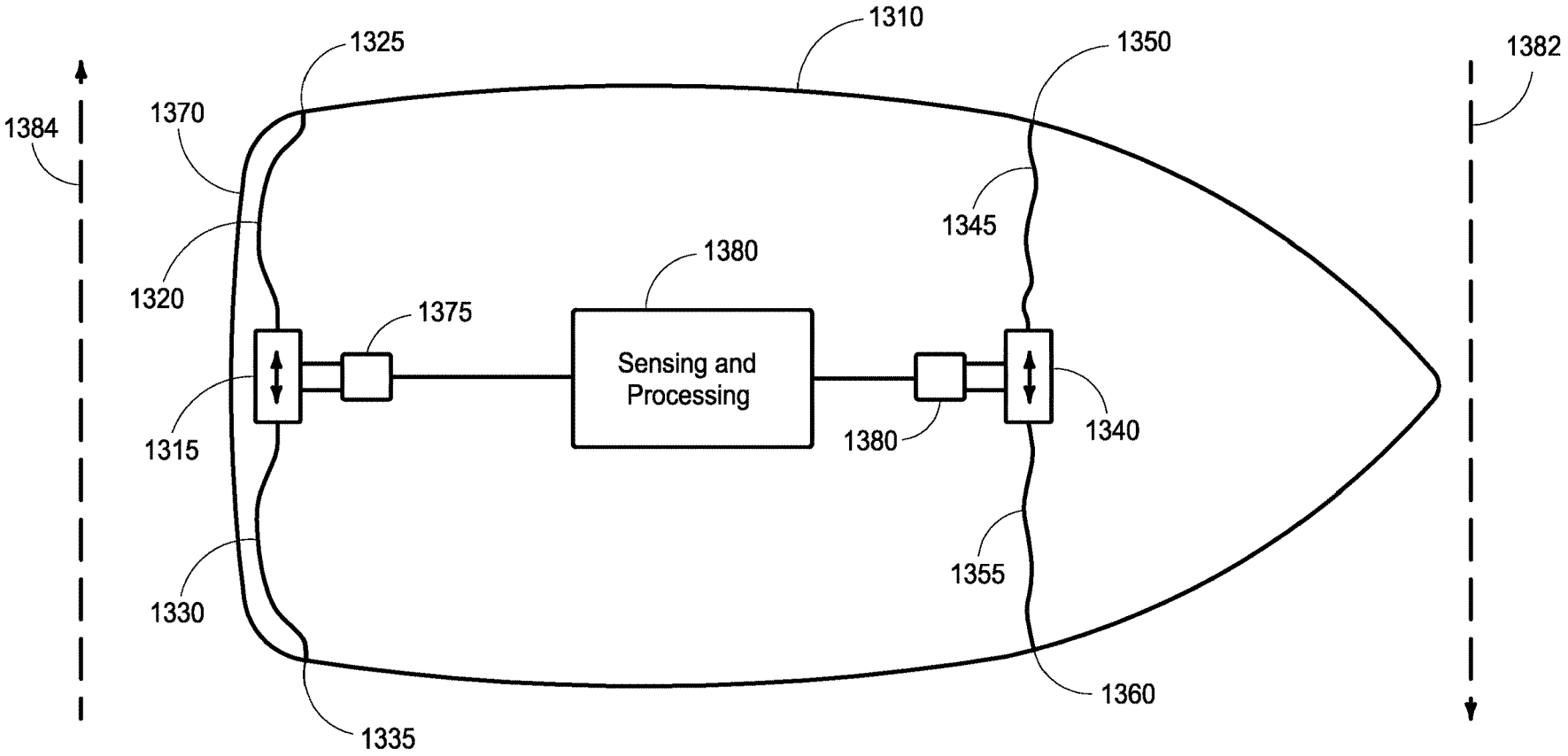
FIG. 14 illustrates a boat propulsion assembly in accordance with yet another embodiment of the disclosure.

The use of multiple thrusters allows the hull to be "shifted" sideways while optionally minimizing forward and rearward movement in the water. FIG. 14 illustrates one embodiment employing dual thrusters with one located toward the front/fore and one located toward the rear/aft. Operation of front/fore assembly including pump 1340 and rear/aft assembly including pump 1315 can be consistent with the operation of the assemblies of FIGS. 10A and 10B. However, the presence of two assemblies—and their locations relatively toward the front/fore (thruster 1340) and rear/aft (thruster 1315)—can provide for more complex hull movements than single thruster embodiments.

For example, if both pump 1315 and pump 1340 are powered to express water out of throughhulls 1325 and 1350 on the left/port side, hull 1310 will experience a relative lateral thrust 1382 shifting it to the right/starboard. Likewise, if both pump 1315 and pump 1340 are powered to express water out of throughhulls 1335 and 1360 on the right/starboard side, hull 1310 will experience a relative lateral thrust 1384 shifting it to the left/port.

Some embodiments may selectively modulate the power to pumps 1315 and 1340 to minimize rotation of hull 1310 during such a lateral shift. Some embodiments may intentionally cause the power to pumps 1315 and 1340 to be dissimilar, to achieve a combination of lateral shift and rotation. Some embodiments may operate pumps 1315 and 1340 in opposite directions to rotate hull 1310 faster than possible with a single pump.

Some embodiments apply the aforementioned partial or full automation to a multiple propulsion assembly configuration. For example, yaw information from sensing and processing 1380 may be used to selectively modulate the power to pumps 1315 and 1340 to maintain orientation of hull 1380, thereby minimizing unintended rotation while the watercraft operator focuses on performing a lateral shift.

Figure 15:
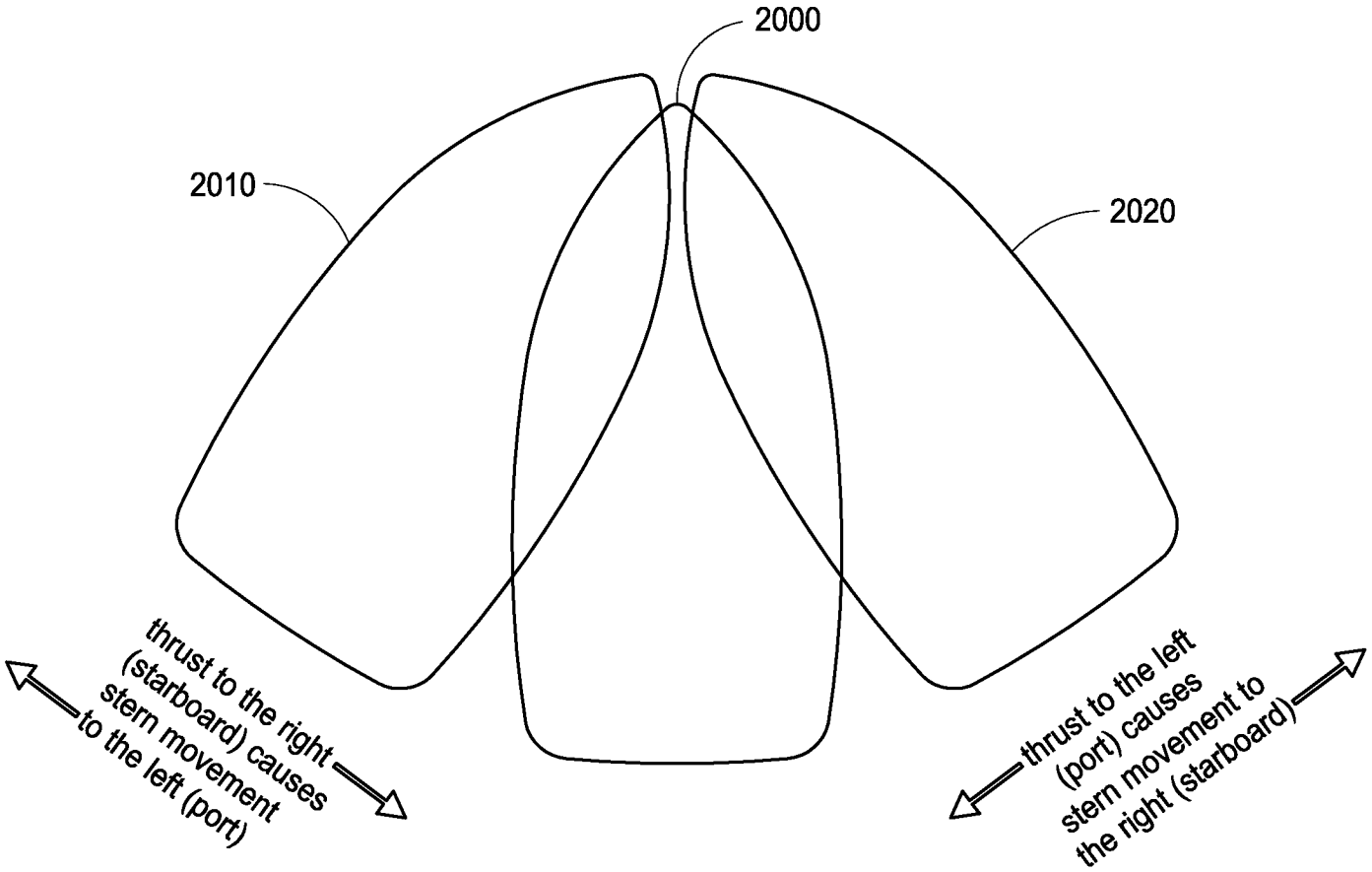
FIG. 15 illustrates methods of propelling a boat in accordance with embodiments of the disclosure.

To illustrate one use case of the assemblies of the present disclosure, FIG. 15 shows the effects on hull 2000 when stern assemblies are activated. When a stern pump creates thrust to the right (starboard), the stern of hull 2000 moves to the left (port) as represented by hull outline 2010. Conversely, when a stern pump creates thrust to the left (port), the stern of hull 2020 moves to the right (starboard) as represented by hull outline 2020. Assemblies installed in the bow of hull 1400 have similar effects on the bow.

In accordance with another embodiment of the disclosure, FIGS. 14A-14C of the present disclosure illustrate assemblies and methods which integrate the propulsion assemblies with a moveable member operatively engaged with a watercraft.

Figure 16C:
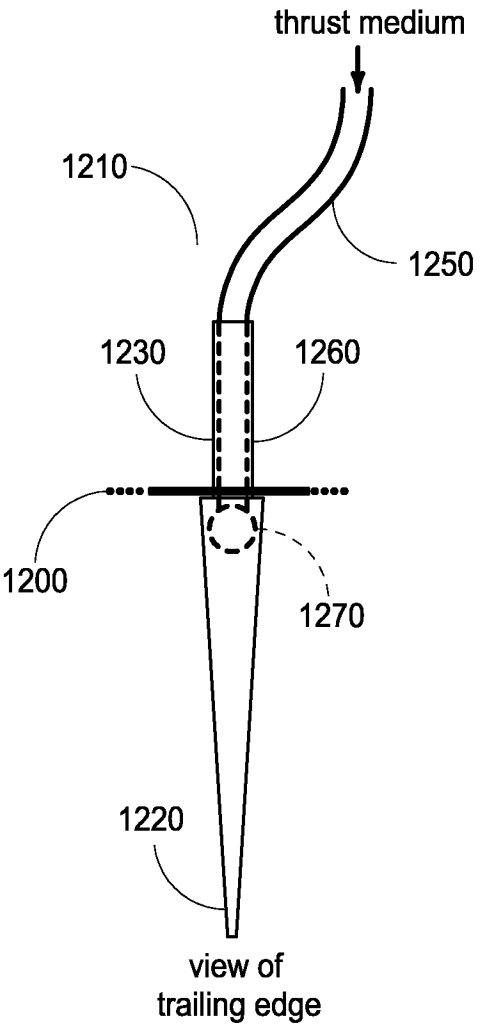
FIGS. 16A-16C illustrate boat propulsion assemblies according to embodiments of the disclosure.
Figure 16B:
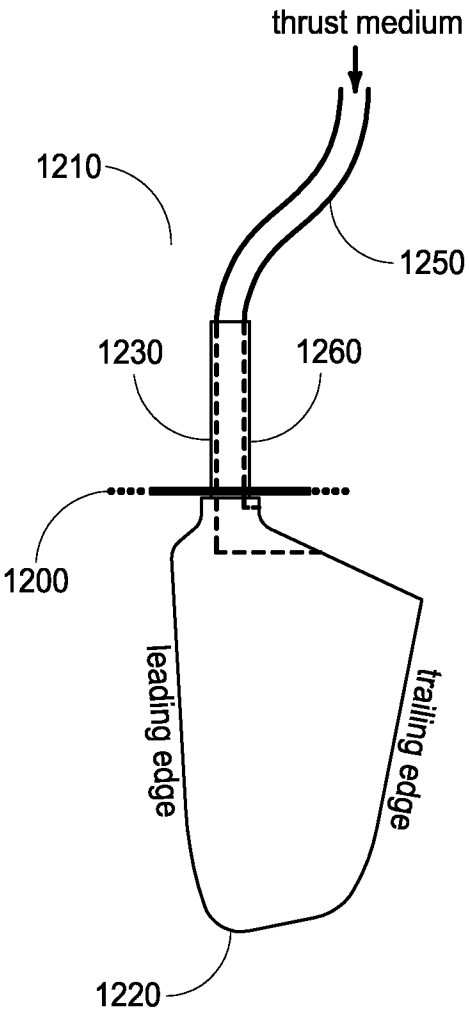
Figure 16A:
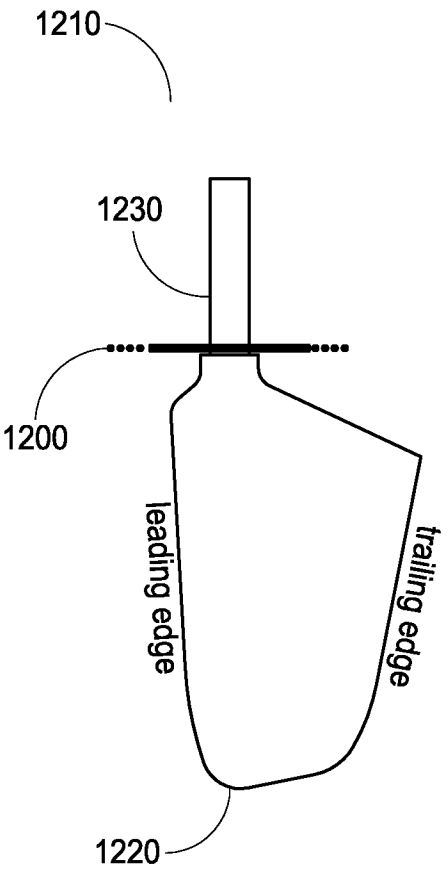

In FIG. 16A, propulsion assembly 1210 is shown configured as a watercraft rudder that can include a member 1220 such as a rudder blade attached to rudder shaft 1230. Rudder shaft 1230 can extend through or along hull 1200 for example, allowing member 1220 to pivot about rudder shaft 1230 to change the orientation of member 1220 relative to hull 1200 and thus steer the watercraft when under power from a propeller, for example. Member 1220 can be any appropriate shape but is often asymmetrical having a leading edge (which is typically proximate the watercraft, for example "forward" when the watercraft is moving forward) and a trailing edge (which is distal or away from the watercraft, for example "rearward" when the watercraft is moving forward).

As shown in the side view of FIG. 16B, some embodiments of the present disclosure create passageway (conduit) 1260 through shaft 1230 to connected conduit 1270 through member 1220. FIG. 16C illustrates a rear view, facing the trailing edge.

Continuing with FIGS. 14B and 14C, thrust medium (in this example, water from a pump) can be conveyed via conduit 1250 to conduit 1260 within shaft 1230, thence to conduit 1270 in member 1220, and finally expressed along the directional axis of member 1220. Note that the direction of thrust is aligned with member 1220—and since member 1220 is steered by the helm of the watercraft, so too is the direction of the member steered by the helm.

Such embodiments of the present disclosure thus provide a technique by which a thruster can be directionally controlled by the primary steering mechanism of the watercraft without requiring complex and elaborate schemes that seek to somehow coordinate the actions of two separate subsystems. Such embodiments may also eliminate the need to attach additional appendages, such as external "thruster propellers" or motors, to the hull or propulsion components.

This integration technique practiced by some embodiments of the present disclosure is not limited to rudders. Outboard marine engines, and so-called "Inboard/Outboard" (I/O) marine engines, often have a water passage by which exhaust cooling water is expressed through the propeller(s). The thruster pump(s) of the present disclosure may be connected to and share such water passages, controlling the direction of the thruster via the watercraft's primary steering mechanism while avoiding the attachment of additional appendages to the hull or propulsion components.

Many types of thruster pumps may be employed by various embodiments of the present disclosure, including those powered by electric motors, hydraulic motors, direct mechanical drives from the engine, or others suited to the application. The thruster pump(s) may be selectively turned on and off manually, automatically based on the behavior of controls such as the steering and/or throttle, based on data from various sensors, and combinations of these and/or other inputs.

The conveyance of water from the pump(s) to conduit 1260 within rudder shaft 1230 may be accomplished using any suitable technique. Examples include but are not limited to fixed or flexible tubing, hose, or other conduit. The connection to passageway 1260 may be achieved via male or female threads, hose barb, adhesive, crimping, or any other technique suited to the specifics of the application and the materials in use. The connection between conduit 1250 and conduit 1260 may be anywhere on member 1230; in some embodiments an end connection may be preferred, while in other embodiments a side connection may be best suited to the application.

Conduits 1260 and 1270 may be of a variety of profiles and cross sections. Conduit 1260 may, for example, may be comprised of a single conduit or multiple separate passageways. Conduit 1270 may be optimized as a single hole anywhere on member 1220, or as a series of holes in any pattern, as a slot running the length of member 1220, as a nozzle of any suitable configuration, or as one or more openings of any shape based upon the needs of the specific watercraft.

For clarity, FIGS. 10B and 10C illustrate conduit 1270 exiting on the trailing edge of member 1220. However, some embodiments may have conduit 1270 exiting on the leading edge, left and/or right faces, and/or other location(s) on rudder blade 1220 as best suits the needs of the specific application, the watercraft, and components involved.

Some embodiments extend conduit 1270 beyond the edge of member 1220 with a tube, nozzle, or other extension. Such an extension may allow the turbulence of the thrust water to be controlled to achieve a more laminar flow, to better interface with the surrounding water, or other design goal.

Some embodiments employ mediums other than water. Air, engine exhaust, or other gases and liquids may be used depending upon the availability of such mediums. For example, some embodiments may use engine cooling water as an existing source of thrust fluid instead of installing an additional pump. The present disclosure may make use of any suitable medium expressed through its passageways to generate selective directional thrust.

As described earlier herein with respect to water pumps used as ballast pumps, a variety of hydraulic valves may be used by some embodiments to regulate the power transferred to hydraulically powered thruster pumps. In some embodiments, simple on/off hydraulic valves are suitable. In some embodiments, proportional/variable hydraulic valves are used to more finely modulate between "fully off" and "fully on".

Control of the pumps and/or hydraulic valves of the present disclosure may be by a variety of techniques. In some embodiments manual control by the watercraft operator is used. In some embodiments, some degree of selective automatic operation supplements or replaces manual control. Such automatic operation can be based on one or more of a variety of criteria including steering direction, compass reading, yaw of the hull, heading of the hull, and/or speed of the hull. Such data may come from any suitable source including sensors integrated into the watercraft, handheld devices, and/or external sources as represented by sensing and processing 1080 of FIG. 12A, 1185 of FIG. 13, and 1380 of FIG. 14, and then used to selectively control hydraulic valve 1090, 1175 and 1180, and 1375 and 1380 respectively to augment and/or replace manual thruster control.

Some embodiments may employ partially and/or fully automated thruster operation to ease the workload upon the operator, heighten safety, and increase convenience. For example, automated operation may be used by some embodiments to augment the normal steering of the watercraft and maintain a straight path through the water. Instead of the operator having to constantly adjust the steering apparatus, a yaw rate or heading measurement may be used to identify when the hull is veering away from a straight path and the thruster(s) may be selectively activated to correct the path of the hull. This may be done during normal at-speed operation, docking, loading onto a trailer, or any other situation where maintaining movement in a straight line is valuable.

As another example, some embodiments may use automation to hold a given orientation in the water when the watercraft is not moving. Idle watercrafts have almost no control over their orientation since their rudders and tracking fins only take effect when they are moving through the water. However, an idle watercraft is still subject to the effects of current and wind which can rotate the hull. Such unintentional rotation is especially unwelcome—and potentially dangerous—when, for example, a watersports participant is in the water trying to swim to the ladder or platform at the transom of the hull. Without the thruster(s) and control of the present invention, the watercraft operator might need to engage the propeller—precisely when it is dangerously near the swimmer, and potentially moving the watercraft further from the swimmer as they strain to climb aboard.

Some embodiments may address this by sensing the orientation of the hull via compass, GPS, yaw, and/or other method(s) and selectively activating the thruster(s) to keep the hull in the desired orientation.

Some embodiments of the present disclosure include the ability to detect fluid in the ballast plumbing. This can act as a safety mechanism, to ensure that ballast draining operations are proceeding as intended. It can also help synchronize on-board systems with actual ballast filling and draining, since there can be some delay between the coupling of power to a ballast pump and the start of actual fluid flow. The flow sensor can be, for example, a traditional inline impeller-style flow sensor; this type of sensor may also yield an indication of volume.

Figure 17:
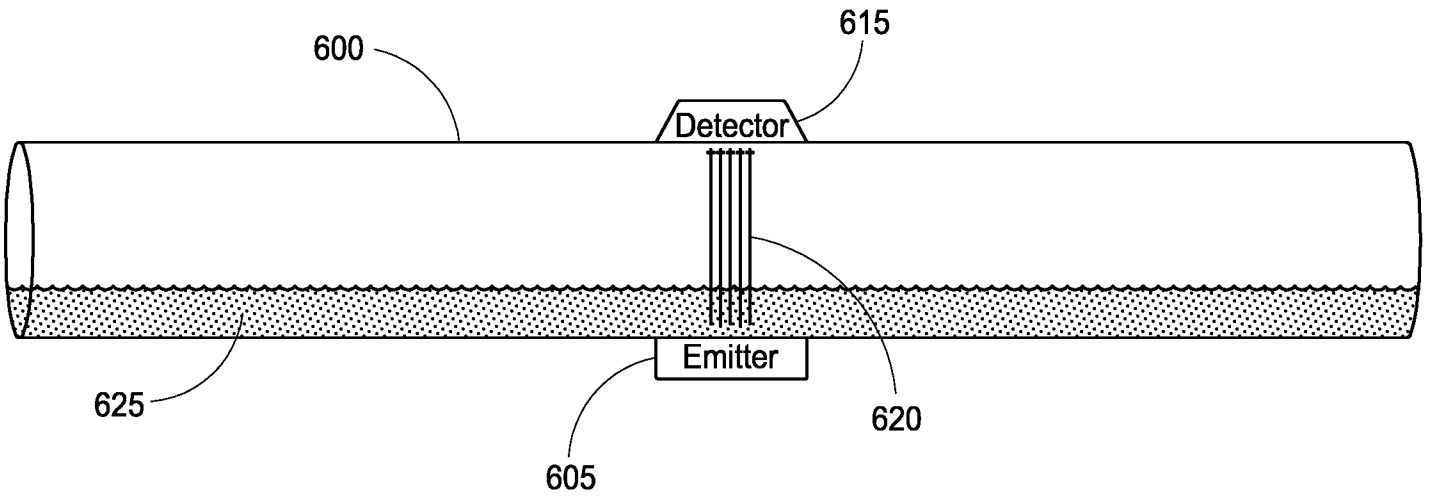
FIG. 17 illustrates one embodiment of the present disclosure using optical sensors to detect the presence of water in ballast plumbing.

Other embodiments may be configured with optical techniques. FIG. 17 illustrates one example of an optical emitter on one side of a transparent portion of the ballast plumbing with a compatible optical detector on the other side. Such an arrangement can provide a non-invasive indication of fluid in a pipe or hose, thereby confirming that ballast pumping is occurring.

In FIG. 17, conduit 600 can include a portion of the ballast plumbing to be monitored. Conduit 600 could be a pipe or hose of generally optically transparent (to the wavelengths involved) material such as clear polyvinyl chloride, popularly known as PVC (product number 34134 from United States Plastic Corporation, 1390 Neubrecht Road, Lima, Ohio 45801), or another material which suits the specific application. Conduit 600 is mounted in the watercraft to naturally drain of fluid when the pumping to be monitored is not active.

Attached to one side of conduit 600 is optical emitter 605. Emitter 605 can be, for example, an LTE-302 (Lite-On Technology, No. 90, Chien 1 Road, Chung Ho, New Taipei City 23585, Taiwan, R.O.C.) or another emitter whose specifications fit the specifics of the application. Attached to the other side, in line with emitter 605's emissions, is optical detector 615. Detector 615 can be, for example, an LTE-301 (Lite-On Technology, No. 90, Chien 1 Road, Chung Ho, New Taipei City 23585, Taiwan, R.O.C.) or another emitter whose specifications fit the specifics of the application. Ideally, the emitter and detector will share a peak wavelength of emission to improve the signal to noise ratio between the two devices.

It should be noted that the transparent portion of the ballast plumbing need only be long enough to permit the installation of emitter 605 and detector 615. Other portions of the ballast plumbing need not be affected.

Continuing with FIG. 15, emissions 620 from emitter 605 thus pass through the first wall of conduit 600, through the space within conduit 600, and through the second wall of conduit 600, where they are detected by detector 615. When fluid is not being pumped, conduit 600 will be almost entirely devoid of ballast fluid and emissions 620 will be minimally impeded on their path from emitter 605 to detector 615.

However, as fluid 625 is added to conduit 600 by pumping operations, the optical effects of fluid 625 will alter emissions 620. Depending upon the choice of emitter 605, detector 615, and the wavelengths they employ, the alterations on emissions 620 could be one or more of refraction, reflection, and attenuation, or other effects. The resulting changes to emissions 620 are sensed by detector 615, allowing for the presence of the pumped fluid 625 to be determined. When pumping is done and conduit 600 drains again, emissions 620 are again minimally affected (due to the absence of fluid 625) and this condition too can be detected.

Figure 18:
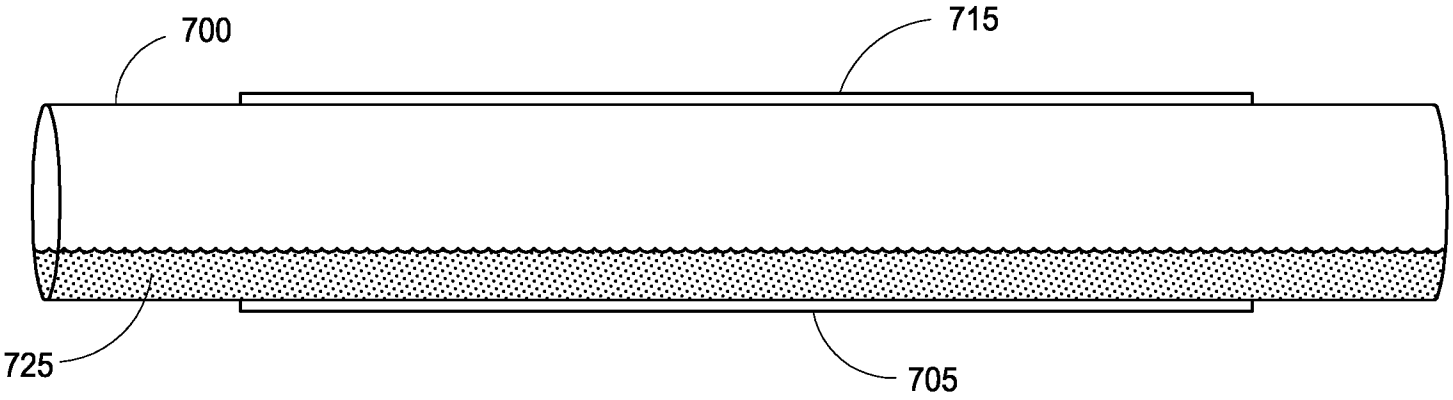
FIG. 18 illustrates one embodiment of the present disclosure using capacitance to detect the presence of water in ballast plumbing.

Another non-invasive technique, employed by some embodiments and shown in FIG. 18, is a capacitive sensor whereby two electrical plates are placed opposite each other on the outside surface of a nonconductive pipe or hose. The capacitance between the plates varies with the presence or absence of fluid in the pipe or hose; the fluid acts as a variable dielectric. This change in capacitance can be used to confirm the presence of fluid in the pipe or hose.

In FIG. 18, conduit 700 can include a nonconductive material. Capacitive contacts 705 and 715 are applied to opposite sides of the outside surface of conduit 700. Contacts 705 and 715 can include a conductive material and can be, for example, adhesive backed metalized mylar, copper sheeting, or another material suited to the specifics of the application.

The length and width of contacts 705 and 715 are determined by 1) the specifics of conduit 700 including but not limited to its diameter, its material, and its wall thickness; and 2) the capacitive behavior of the ballast fluid to be pumped. The surface areas of contacts 705 and 715 are chosen to yield the desired magnitude and dynamic range of capacitance given the specifics of the application.

When fluid is not being pumped, conduit 700 will be almost entirely devoid of ballast fluid and the capacitance between contacts 705 and 715 will be at one (the "empty") extreme of its dynamic range. However, as fluid 725 is added to conduit 700 by pumping operations, the fluid 725 changes the dielectric effect in conduit 700, thus altering the capacitance between contacts 705 and 715. When conduit 700 is filled due to full pumping being underway, the capacitance between contacts 705 and 715 will be at the "full" extreme of the dynamic range. The resulting changes to the capacitance allow the presence of the pumped fluid 725 to be determined. When pumping is done and conduit 700 drains again, the capacitance returns to the "empty" extreme (due to the absence of fluid 725) and this condition too can be detected.

Other sensor types can be easily adapted for use with the present disclosure. Those specifically described herein are meant to serve as examples, without restricting the scope of the sensors that may be employed.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A hydraulic power source for watercraft, the power source comprising:

a watercraft having an engine;

a variable ratio drive assembly operably engaged with the engine;

a hydraulic pump operably engaged with the variable ratio drive assembly;

a hydraulic motor powered by the hydraulic pump; and at least one of a flexible vane impeller pump and/or a centrifugal pump powered by the hydraulic motor.

2. The hydraulic power source for watercraft of claim 1 wherein the variable ratio drive assembly is operably engaged with the engine via a shaft or geared connection.

3. The hydraulic power source for watercraft of claim 1 wherein the variable ratio drive assembly is operably engaged with the engine via a belt or chain.

4. The hydraulic power source for watercraft of claim 1 wherein the variable ratio drive assembly is configured to selectively adjust its ratio of input RPM to output RPM.

5. The hydraulic power source for watercraft of claim 1 wherein the hydraulic motor is powered by the hydraulic pump via at least one hydraulic supply hose and one hydraulic return hose between the hydraulic pump and the hydraulic motor.

6. The hydraulic power source for watercraft of claim 1 further comprising at least one hydraulic valve operatively engaged between the hydraulic pump and the hydraulic motor.

7. The hydraulic power source of claim 1 wherein the flexible vane impeller pump or the centrifugal pump is configured as a ballast pump.

8. The hydraulic power source of claim 1 wherein the flexible vane impeller pump is reversible.

9. The hydraulic power source of claim 1 further comprising at least one hydraulic valve operatively engaged between the hydraulic pump and the hydraulic motor.

10. The hydraulic power source of claim 1 wherein the flexible vane impeller pump or the centrifugal pump is configured as a thruster.

11. A method for providing hydraulic power aboard a watercraft, the method comprising:

using an engine of the watercraft to drive a variable ratio drive assembly;

using the variable ratio drive assembly to drive a hydraulic pump;

using the hydraulic pump to power a hydraulic motor; and using the hydraulic motor to drive a flexible vane impeller pump or a centrifugal pump.

12. The method of claim 11 further comprising using the variable ratio drive assembly to selectively adjust its ratio of input RPM to output RPM using one or more of centrifugal force, centripetal force, input engine RPM, output hydraulic pump RPM, power availability from the engine, and/or power consumption of the hydraulic pump.

13. The method of claim 11 wherein the flexible vane impeller pump or the centrifugal pump is configured as a ballast pump.

14. The method of claim 11 wherein the flexible vane impeller pump is reversible.

15. The method of claim 11 wherein the flexible vane impeller pump or the centrifugal pump is configured as a thruster.

16. The method of claim 11 further comprising using the variable ratio drive assembly to selectively adjust the ratio of input RPM to output RPM to reduce the total range of hydraulic pump RPM.

17. The method of claim 11 further comprising using at least one hydraulic valve to selectively start, stop, and/or reverse the flow of hydraulic fluid between the hydraulic pump and hydraulic motor.

* * * * *